US011007400B1

(12) United States Patent
Stoddard et al.

(10) Patent No.: US 11,007,400 B1
(45) Date of Patent: May 18, 2021

(54) CONVERTIBLE FURNITURE

(71) Applicant: James Stoddard, Carlsbad, CA (US)

(72) Inventors: James Stoddard, Carlsbad, CA (US); James E. Grimes, Yorba Linda, CA (US)

( * ) Notice: Subject to any disclaimer, the term of this patent is extended or adjusted under 35 U.S.C. 154(b) by 0 days.

(21) Appl. No.: 17/248,941

(22) Filed: Feb. 12, 2021

Related U.S. Application Data

(63) Continuation-in-part of application No. 16/129,226, filed on Sep. 12, 2018.
(Continued)

(51) Int. Cl.
*A47C 13/00* (2006.01)
*A47C 7/00* (2006.01)
(Continued)

(52) U.S. Cl.
CPC ..... *A63B 21/4029* (2015.10); *A47C 13/00* (2013.01); *A47C 31/10* (2013.01); *A63B 21/0023* (2013.01); *A63B 21/0552* (2013.01); *A63B 21/078* (2013.01); *A63B 21/151* (2013.01); *A63B 21/4035* (2015.10); *A63B 23/02* (2013.01); *A63B 23/0482* (2013.01); *A63B 23/1236* (2013.01); *A63B 71/0622* (2013.01); *A63B 69/06* (2013.01); *A63B 2071/0658* (2013.01); *A63B 2210/02* (2013.01);
(Continued)

(58) Field of Classification Search
CPC ..... A47C 13/00; A47C 13/005; A47C 17/34; A47C 17/62; A63B 21/0023; A63B 21/0552; A63B 21/078; A63B 21/121; A63B 23/02; A63B 23/0482; A63B 23/1236; A63B 21/4029; A63B 21/4035; A63B 69/06; A63B 71/0622; A63B 2071/0658; A63B 2210/02; A63B 2210/50; A63B 2225/093
USPC ... 297/423.39, 423.4, 423.41, 440.1, 440.14, 297/462, 118, 233, 248; 482/52, 121, 482/123, 130, 148
See application file for complete search history.

(56) References Cited

U.S. PATENT DOCUMENTS 1,900,474 A * 3/1933 Wilson ..... A47C 17/34 297/233
2,187,689 A * 1/1940 Jaray ..... A47C 17/16 297/233
(Continued)

FOREIGN PATENT DOCUMENTS

WO WO-2019056714 A1 * 3/2019 ..... A47C 9/00

*Primary Examiner* — Rodney B White
(74) *Attorney, Agent, or Firm* — Charles L. Thoeming

(57) ABSTRACT

Various embodiments of convertible furniture are disclosed. The convertible furniture can have one or more benches with one or more platforms. The convertible furniture can have a work mode and an exercise mode. In the work mode, the convertible furniture can be configured to function as a workstation and/or work cubicle for an office worker, or furniture items in a home or office. In the exercise mode, the convertible furniture can be converted to a substantially flat work-out surface formed by surfaces of the benches and platforms. The workout surface can be configured for exercising, such as stretching, yoga, Pilates, and/or otherwise. In some embodiments, the work-out surface is adapted to receive, support, and configure a variety of exercise equipment attachment assemblies and related exercise related items.

22 Claims, 34 Drawing Sheets

Related U.S. Application Data

(60) Provisional application No. 62/693,562, filed on Jul. 3, 2018, provisional application No. 62/558,217, filed on Sep. 13, 2017.

(51) Int. Cl.

| | |
|---|---|
| ***A47C 7/50*** | (2006.01) |
| ***A47C 7/62*** | (2006.01) |
| ***A47C 9/00*** | (2006.01) |
| ***A47C 16/02*** | (2006.01) |
| ***A63B 21/00*** | (2006.01) |
| ***A47C 31/10*** | (2006.01) |
| ***A63B 21/002*** | (2006.01) |
| ***A63B 23/04*** | (2006.01) |
| ***A63B 23/02*** | (2006.01) |
| ***A63B 21/078*** | (2006.01) |
| ***A63B 23/12*** | (2006.01) |
| ***A63B 21/055*** | (2006.01) |
| ***A63B 71/06*** | (2006.01) |
| *A63B 69/06* | (2006.01) |

(52) U.S. Cl.
CPC ..... *A63B 2210/50* (2013.01); *A63B 2225/093* (2013.01)

(56) References Cited

U.S. PATENT DOCUMENTS 2,466,204 A * 4/1949 Brown ..... A47C 3/029 297/233 X
3,186,758 A * 6/1965 Wanzenried ..... A47C 17/30 297/233 X
3,635,521 A * 1/1972 Shivvers ..... A47B 85/04 297/248 X
3,738,699 A * 6/1973 Fain ..... B60P 3/32 296/168
3,811,728 A * 5/1974 Redemske ..... A47B 87/00 297/440.14
3,890,658 A * 6/1975 Petersilie ..... A47C 17/1655 5/2.1
3,944,281 A * 3/1976 Piretti ..... A47B 87/00 297/440.14
4,032,188 A * 6/1977 Jones ..... A47C 11/00 297/232
4,077,666 A * 3/1978 Heumann ..... A47C 13/005 297/248
5,730,688 A * 3/1998 Prusick ..... A63B 23/0211 297/353
5,860,897 A * 1/1999 Gilbert ..... A63B 21/0552 482/130
6,105,913 A * 8/2000 Couture ..... A47B 49/002 248/274.1
6,280,366 B1 * 8/2001 Hsieh ..... A63B 22/0012 482/130
6,402,669 B1 * 6/2002 Olstad ..... A63B 21/045 482/123
6,616,580 B1 * 9/2003 Chen ..... A63B 21/023 482/130 X
6,796,614 B1 * 9/2004 Paul ..... A47C 7/42 297/440.14 X
6,908,417 B2 * 6/2005 Jackson ..... A63B 21/0552 482/123
7,181,783 B2 * 2/2007 O'Reilly ..... A47C 19/22 297/440.14
7,237,845 B2 * 7/2007 Mulmed ..... A47C 7/24 297/233
7,347,493 B2 * 3/2008 Mulmed ..... A47B 87/007 297/233
7,419,220 B2 * 9/2008 White, III ..... A47C 17/045 297/440.14
7,704,199 B2 * 4/2010 Koch ..... A63B 21/026 482/130
7,806,474 B2 * 10/2010 Wahl ..... A47C 13/005 297/248
7,922,253 B2 * 4/2011 Chen ..... A47C 17/02 297/440.1
8,137,249 B2 * 3/2012 Koch ..... A63B 23/03541 482/121 X
8,322,793 B2 * 12/2012 Chen ..... A47C 4/028 297/440.14 X
8,500,612 B2 * 8/2013 Koch ..... A63B 23/1209 482/121 X
8,528,972 B2 * 9/2013 Johnsson ..... A47C 4/02 297/248
8,696,531 B1 * 4/2014 Spiller ..... A47C 13/00 482/130
8,764,114 B1 * 7/2014 Frank ..... A47C 13/005 297/248 X
9,039,583 B2 * 5/2015 Huang ..... A63B 23/03541 482/130 X
9,060,606 B1 * 6/2015 Steinbok ..... B65D 81/36
10,123,623 B2 * 11/2018 Nelson ..... A47C 7/20
10,159,355 B2 * 12/2018 Policicchio ..... G11C 7/06
2002/0091047 A1 * 7/2002 Olstad ..... A63B 21/4047 482/130 X
2005/0046243 A1 * 3/2005 Cimino ..... A47C 13/005 297/124
2005/0164855 A1 * 7/2005 Li ..... A63B 71/0036 482/142
2007/0087920 A1 * 4/2007 Dachraoui ..... A63B 21/0552 482/121 X
2007/0270292 A1 * 11/2007 Laney ..... A63B 21/4035 482/121
2011/0101747 A1 * 5/2011 Chen ..... A47C 13/005 297/233
2014/0162853 A1 * 6/2014 Kadar ..... A63B 21/026 482/130
2016/0016030 A1 * 1/2016 Stout ..... A63B 21/1609 482/130
2016/0193492 A1 * 7/2016 Caruso ..... A63B 21/4035 482/130

* cited by examiner

924
ARM REST FRONT VIEW
CONCAVE FOR LEG

FLAT POSITION
STRETCHING HAMSTRING
926
918

922
920
912
918
ARM REST HINGES AND
TELESCOPES VERTICALLY
FOR LEG SUPPORT 906
918
904
916
FLAT TABLE
914

CONVERTIBLE FURNITURE

CROSS-REFERENCE

This application claims the priority benefit of U.S. Provisional Application No. 62/558,217, filed Sep. 13, 2017, U.S. Provisional Application No. 62/693,562, filed Jul. 3, 2018, and U.S. Non-provisional application Ser. No. 16/129,226, filed Sep. 12, 2018, the entirety of each of which is incorporated herein by reference.

BACKGROUND

Technical Field

The present disclosure relates to work cubicles and lifestyle office and/or home furniture.

Certain Related Art

A sedentary lifestyle can be harmful, such as leading to lower back pain, stiff joints, low metabolic rate, accelerated aging, and/or otherwise. Some jobs require long periods of sitting or of little movement, such as at a desk in an office. Some furniture can encourage people to remain sedentary (e.g., while working, at home, and/or elsewhere) for extended periods. For example, a couch may encourage a person to remain sedentary.

SUMMARY OF CERTAIN FEATURES

Some furniture is passive, such as a traditional seated desk and/or a traditional couch. Traditional passive furniture (e.g., traditional seated chairs and/or couches) can hurt a user's lower back and/or cause one's knees to stiffen and/or ache for being in a bent position for too long. Some passive furniture (e.g., an ergonomic chair) can encourage people to sit in a proper way, but fails to alleviate certain other problems, such as problems with bent knees. Passive furniture does not encourage a user to move and/or does not improve a user's strength, endurance, and/or flexibility (e.g., in the back, legs, and/or shoulders).

Some furniture is active, such as balance ball chairs, standing desks, treadmill desks, and bike desks. Active furniture can encourage people to move without having to leaving the office or home. Active furniture can improve a user's strength, endurance, and/or flexibility. Active furniture can beneficially enable a user to exercise while doing other tasks, such as working. However, active furniture can be bulky and occupy a large space and/or footprint. Active office furniture products may not provide the same work surface area as a traditional seated desk. Thus, the active office furniture may be limited to supplementing a traditional seated desk. This can be costly and space consuming. Because active office furniture products can cost more than a traditional seated desk, employers may be unwilling to invest in and/or employees may not afford active office furniture.

Some office workers may be assigned work cubicles or a small office. Some work cubicles can have a length of about 5 feet to about 8 feet and/or a width of about 5 feet to about 10 feet. Some offices may have similar sizes as some of the work cubicles. The work cubicles and/or offices may not fit some of the active office furniture products or may cause the workspace to be crowded.

Some active office furniture may not be suitable for people who prefer sitting at a desk. Some people may find a treadmill and/or bicycle chair in an office distracting. Some people may dislike exercising while working and/or may find it to reduce their productivity. Some people may not like exercising in business attire. Some people may have a condition (e.g., weak and/or injured lower body joints) that makes walking, running and/or biking unsuitable forms of exercise for these people. Some people may prefer flexibility exercises, such as stretching, practicing yoga poses, and/or otherwise rather than walking, running and/or biking.

Some exercises require ample space and/or a certain type of surface. For example, some flexibility exercises typically are performed on a substantially flat surface. Some work cubicles and/or offices may not have an open surface sufficiently large to allow flexibility exercises. Traveling to a location a distance away from a workspace (e.g., desk) during a workday can be inconvenient and/or can reduce productivity.

Various embodiments of articles of convertible furniture that solve one or more of the problems, or other problems, are disclosed in this application. In some embodiments, the convertible furniture comprises a dual-function article. For example, the convertible furniture can comprise a dual-function sectional, couch, chair, futon, table, desk, or other article of furniture. In some embodiments, the dual-function article comprises a work cubicle. The dual-function work cubicle can have one or more divider walls.

The convertible furniture can have a work mode and an exercise mode. The convertible furniture can comprise one or more hinged benches. In the work mode, the convertible furniture can be configured to function as a workstation for a user. In the exercise mode, the convertible furniture can be adapted and/or modified to have a substantially flat workout surface formed by surfaces of the benches. The workout surface can be configured for exercises (e.g., stretching, yoga, Pilates, or otherwise) and/or for resting. The convertible furniture can be configured to readily and/or quickly convert between the work and exercise modes. The dual modes of the convertible furniture can enable, and even encourage, the user to exercise and/or rest during breaks at work without having to leave their workspace (e.g., cubicle).

Various embodiments of articles of convertible furniture can be beneficial compared to traditional furniture, ergonomic furniture, and/or active furniture. The convertible furniture can enable a user to exercise (e.g., stretch) while simultaneously conducting work or other tasks. Exercise can promote the user's health, such as by improving the user's blood circulation, cardiovascular functions, and/or flexibility. Exercise can reduce pain (e.g., muscle pain, joint pain, headache, or others) and can reduce stress and anxiety. Exercise can improve the user's immune system, reduce the chance of the user becoming ill, and/or decrease the number of sick days that a user may need to take. Exercise can improve the user's productivity, for example, by refreshing the user's brain.

The convertible furniture can encourage and/or provide space for a user to move around and/or exercise. The convertible furniture can provide for the user an elevated platform, which can be preferable compared to sitting on the floor (e.g., due to hygiene concerns, ease of sitting down and/or getting up, ease of viewing an elevated TV screen or computer monitor screen, or other reasons, vantage point, etc.). In some embodiments, the convertible furniture enables the user to conduct work or other tasks without office chairs, desks, and/or couches. In various embodiments, the convertible furniture does not require additional special fitness equipment (e.g., Pilates table or rowing machine), though some embodiments are adapted to facilitate the use of such equipment. The convertible furniture can save space and be configured for small spaces, such as a work cubicle and/or a small home. The user may not need additional furniture and can lead an ecologically friendly lifestyle.

Facilities with embodiments of the convertible furniture can have an indicator, such as a sign (e.g., in a plaque). The indicator can indicate that the facility contains convertible furniture, such as to alert visitors. For example, the convertible furniture can be included or installed in a conference room. A sign can be placed outside the conference room (e.g., on the door) to indicate that the conference room includes the convertible furniture. Some variants include a combination of the convertible furniture and passive furniture (e.g., traditional desks and/or chairs), which can allow users to choose the furniture they prefer.

BRIEF DESCRIPTION OF THE DRAWINGS

Various embodiments are depicted in the drawings for illustrative purposes and should in no way be interpreted as limiting the embodiments. In addition, various features of different disclosed embodiments can be combined to form additional embodiments, which are part of this disclosure. In the drawings, similar elements have reference numerals with the same last two digits.

DETAILED DESCRIPTION OF CERTAIN EMBODIMENTS

Figure 1A:
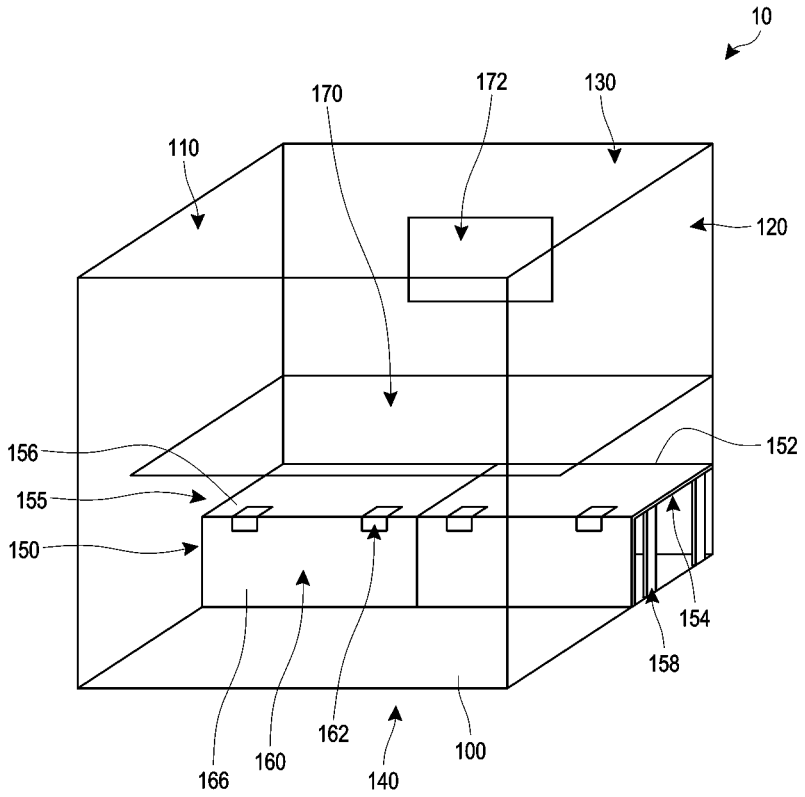
FIGS. 1A and 1B schematically illustrate perspective views of an example dual-function work cubicle in a work mode and an exercise mode, respectively.

Although certain embodiments and examples are described below, those of skill in the art will appreciate that the disclosure extends beyond the specifically disclosed embodiments and/or uses obvious modifications and equivalents thereof. Thus, it is intended that the disclosure herein disclosed should not be limited by any particular embodiments described below.

Overview

Several embodiments of convertible furniture are disclosed. The convertible furniture is described with a work cubicle environment, due to particular utility in that context. Certain embodiments of the convertible furniture are described as a work cubicle or a cubicle. However, the convertible furniture can be used in many other contexts, such as in a non-cubicle environment, residence, outdoor setting, or otherwise.

In various embodiments, the convertible furniture (e.g., a work cubicle) has a work mode and an exercise mode. When in the work mode, the cubicle can have the appearance and/or function of a typical work cubicle with a desk-top and sufficient space for a chair and/or for standing. In some embodiments, in the exercise mode, the cubicle comprises an exercise space having a substantially flat platform. The platform can be used for a workout routine, such as stretching, yoga or Pilates. The platform can be used for exercising, meditation, resting, and/or napping.

In some embodiments, the work cubicle has a generally U-shaped bench. The bench can have one or more hinged platforms having an extended position and a retracted position. The platforms can be in the retracted position when the cubicle is in the work mode. When in the extended position, surfaces of the bench and the hinged platforms can define a cockpit area. The cockpit area can be configured to accommodate a chair with an upright back in the work mode. The chair back can be folded onto a chair seat to form a substantially flat surface in the exercise mode. Surface of the chair back, the bench, and the hinged platforms can be combined and/or adapted to form a workout surface.

In certain implementations, the platform in the retracted position can leave an open space configured to accommodate a Pilates table or a rowing machine. In some implementations, the work cubicle can include a rigid frame configured to support an overhead system providing attachment locations for exercise accessories.

In various embodiments, the conversion from the work mode to the exercise mode is quick and easy. For example, the process can take less than or equal to about: 1 minute, 2 minutes, 3 minutes, 5 minutes, or other time periods. The process can occur without requiring the user to lift heavy objects, such as over 20 lbs. The conversion process can be convenient for the user, such as by not requiring the user to travel away from their work area. A quick, easy, and convenient conversion process can encourage the user to exercise. For example, when the user is feeling stressed and/or wants to take a break from work, the user can quickly, easily, and conveniently convert the cubicle to the exercise mode to exercise and/or rest, and then quickly, easily, and conveniently convert the cubicle back to the work mode.

Certain Dual-Function Work Cubicles with Hinged Benches

Figure 1B:
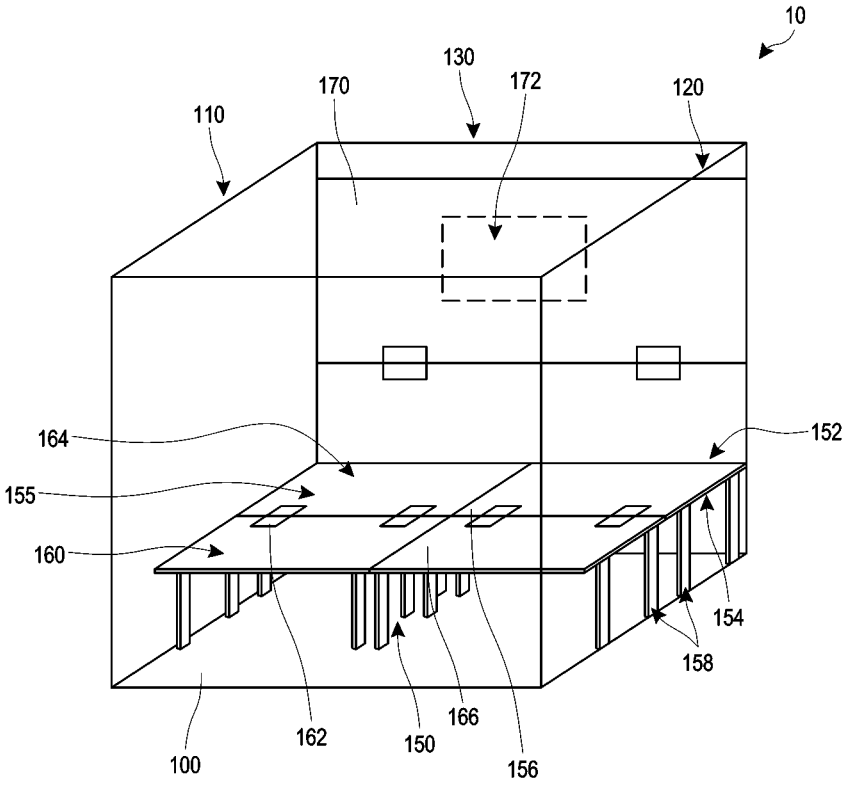

FIGS. 1A and 1B schematically illustrate an embodiment of a dual-function work cubicle 10. FIG. 1A illustrates the cubicle 10 in a work mode. FIG. 1B illustrates the cubicle 10 in an exercise mode.

The cubicle 10 can have one or more generally vertical dividers defining boundaries of a portion of a floor of a room 100 occupied by the cubicle 10. The portion of the floor 100 enclosed by the one or more vertical dividers can be a square, rectangle, or other shape. The enclosed floor portion 100 can bound a space for the user at work. In some embodiments, the cubicle 10 can have a first divider 110. In some embodiments, the cubicle 10 can have a second divider 120. In some embodiments, such as schematically illustrated in FIGS. 1A and 1B, the cubicle 10 can have an intermediate divider 130 between the first divider 110 and the second divider 120. The vertical dividers 110, 120, 130 can have a generally rectangular or square shape. The vertical dividers 110, 120, 130 can extend substantially vertically from the floor or a smaller height near the floor toward a ceiling of the room. The dividers 110, 120, 130 can be available in different heights, for example, in low, medium, and/or high heights. The dividers 110, 120, 130 can extend substantially as high as the ceiling. The cubicle 10 can have an entrance 140. In some embodiments, such as illustrated in FIGS. 1A and 1B, the entrance 140 can be between the first and second dividers 110, 120 and can face the intermediate divider 130.

The cubicle 10 can have at least one bench 150. The bench 150 can have a long side 152 and a short side 154. In some implementations, such as illustrated in FIGS. 1A and 1B, the cubicle 10 can have two benches 150. The two benches 150 can be positioned side by side along the short sides 154 of the benches 150. The long side(s) of the bench(es) can substantially occupy an entire width of the enclosed floor portion 100. In some embodiments, such as shown in FIGS. 1A and 1B, the benches 150 can be positioned near or adjacent the intermediate divider 130. The long side 154 can align generally with the intermediate divider 130. The short side 152 can align generally with the first or second divider 110, 120. In some implementations, the benches 150 can be secured to the intermediate divider 130, the first divider 110, and/or the second divider 120 with fastener(s), such as nail(s), screw(s), adhesive, Velcro, magnet(s), or otherwise.

The bench 150 can comprise a substantially flat slab 155. The slab 155 can have a substantially flat top surface 156. The slab 155 can be supported by a plurality of (such as four) legs 158. The legs 158 can have a square, rectangular, circular, or other cross-sectional shape. In some embodiments, the legs 158 can have an outer dimension (such as a diameter or a diagonal length) of about 2 inches. The top surface 156 can have a height less than a height of a desk configured for use when the user sits at the desk. The height of the top surface 156 can be between about 15 inches to about 35 inches, or about 20 inches. The bench 150 can have a platform 160. The platform 160 can have a substantially flat platform surface 166. In some embodiments, the length of the surface 166 is substantially the same as the long side 152 of the bench 150. The platform surface 166 can have a width substantially the same as, or less than, the height of the top surface 156.

The platform 160 can be hingedly coupled to the slab 155 via at least one hinge 162 (for example, butt hinges, slip joint hinges, or otherwise). The hinge 162 can be along the long side 152 of the bench 150. The hinge 162 can be installed on the top surface 156 and the platform surface 166. The hinge 162 can be installed on a bottom surface of the top slab 155, opposite the top surface 156, and/or a bottom surface of the hinged platform 160, opposite the platform surface 166.

The hinged platform 160 can be configured to rotate at the hinge 162 between a retracted position and an extended position. FIG. 1A schematically illustrates the hinged platform 160 in the retracted position. The platform surface 166 can form a non-zero angle (for example, an acute angle, a right angle, or an obtuse angle) with the substantially flat top surface 156 when in the retracted position. As illustrated, in some embodiments, in the retracted position, the platform surface 166 is generally perpendicular to the substantially flat top surface 156. In certain embodiments, in the retracted position, the platform surface 166 can be and/or is positioned partially or completely below (e.g., at a lower elevation than) the substantially flat top surface 156. The hinged platform 160 can be maintained at the retracted position, such as by gravity, a releasable fastener (such as magnet(s), Velcro, or otherwise), or otherwise. In the various embodiments, the volume below the top slab 155 can be used as storage space. For example, the platform 160 can be rotated to provide access to the volume under the surface 150.

FIG. 1B schematically illustrates the hinged platform 160 in the extended position. The platform surface 166 can be generally flush and/or level (e.g., at about 0° or about) 180°, with the substantially flat top surface 156 when in the extended position. The platform surface 166 and the top surface 156 can form a workout surface 164. The bench 150 can have a latching feature (such as a hook, a door latch, a cable pulling from the divider, magnets, or otherwise) for maintaining the hinged platform 160 in the extended position. As shown in FIG. 1B, the platform 160 can have a plurality of (such as two) legs 158 supporting the platform 160 in the extended position. In some embodiments, the plurality of legs 158 of the platform 160 can be folded onto or near the underside of the platform 160 in the retracted position.

The cubicle 10 can have a desk-top 170. The desk-top 170 can be installed on the divider 130. The desk-top 170 can have an extended position and a stowed position. FIG. 1A schematically illustrates the desk-top 170 in the extended position. For purposes of presentation, the desk-top 170 is illustrated as transparent, though it can be opaque. The desk-top 170 can be generally parallel to the floor and/or generally perpendicular to the divider 130 when in the extended position. The desk-top 170 can rotate about a long side away from the divider 130 to reach the extended position. FIG. 1B schematically illustrates the desk-top 170 in the stowed position. The desk-top 170 can be generally parallel and/or close to the divider 130 when in the stowed position. The desk-top 170 can be rotated about its long side toward the divider 130 to reach the stowed position. The desk-top 170 can be maintained in the extended and/or stowed positions by a latching feature, such as described above. In some embodiments, the desk-top 170 can be installed on the divider 110 or 120 and rotate about its short side to move between the extended and stowed positions. When in the extended position, the desk-top 170 can be higher than the bench top surface 156. In some embodiments, the desk-top 170 can be at a height suitable for a user sitting on a chair when in the extended position. In some embodiments, the desk-top 170 can be configured to be a standing desk. In some embodiments, the desk-top 170 can have adjustable heights configured to allow the desk-top 170 to be suitable for both sitting and standing.

The cubicle 10 can have a computer monitor screen 172 mounted on the divider 130. In some embodiments, the monitor screen 172 can be mounted on the first or second divider 110, 120. The monitor screen 172 can be mounted above the desk-top 170 when the desk-top 170 is in the extended position. In some embodiments, the monitor screen 170 can have a flat screen. In some implementations, an angle of the monitor screen 172 can be adjustable in more than one direction.

In some embodiments, such as shown in FIG. 1A, the cubicle 10 is in the work mode. The desk-top 170 can be in the extended position configured to provide a surface for performing work tasks, such as writing, typing, reviewing documents, and/or otherwise. The hinged platform 160 can be in the retracted position and out of the way of the user's legs when the user sits and/or stands next to the desk-top 170. The dividers 110, 120, 130 can provide privacy and/or reduce distractions to the user during the work mode.

In some embodiments, such as shown in FIG. 1B, the cubicle 10 is in the exercise mode. In various embodiments, in the exercise mode, the cubicle 10 is adapted to provide the workout surface 164. For example, the hinged platform 160 can be in the extended position, forming the workout surface 164 comprising the bench top surface 156 and the platform surface 166. The platform surface 166 in the extended position can extend over at least a portion of the floor 100 not under the bench 150 in the work mode. In some embodiments, the workout surface 164 can cover substantially an entirety of the enclosed floor portion 100 and/or substantially the occupiable footprint of the cubicle. In some embodiments, the platform surface 166 in the extended position can extend to or near the entrance 140. The desk-top 170 can be in the stowed position and out of the way of the user when the user exercises on the workout surface 164. The monitor screen 172 can be hidden behind the stowed desk-top 170. The dividers 110, 120, 130 can provide privacy and/or reduce distractions to the user during the exercise mode. The user can convert the cubicle 10 from the work mode to the exercise mode conveniently whenever the user wants to take a break from work and exercise. The conversion can comprise stowing the desk-top 170 and moving (e.g., pulling) the hinged platform 160 to the extended position.

Certain Dual-Function Work Cubicles with Benches Forming an Angle

Figure 2A:
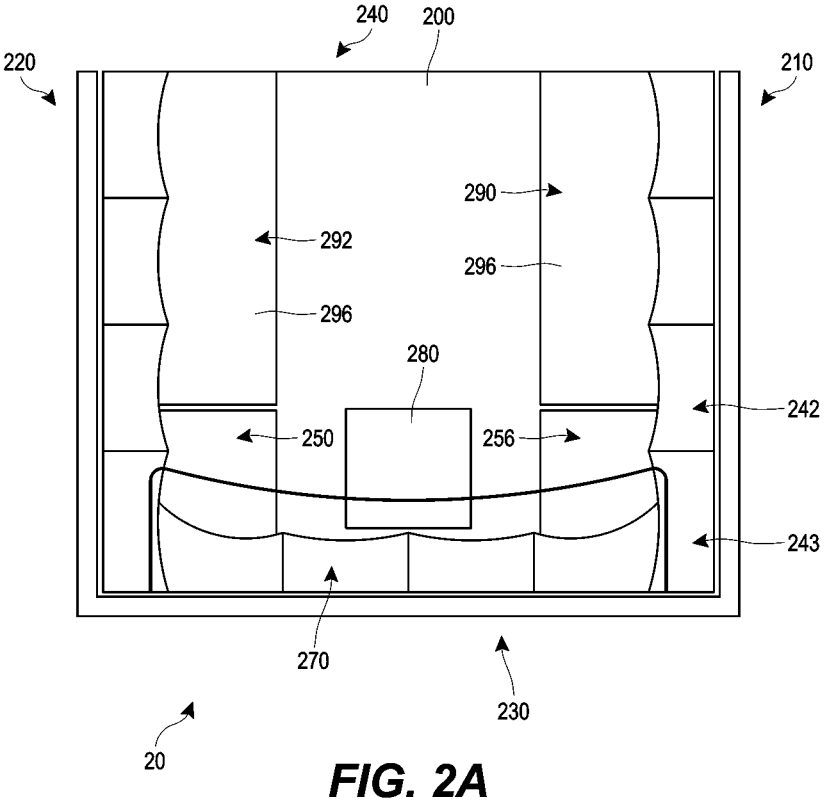
FIG. 2A schematically illustrates a top view of an example dual-function work cubicle in a work mode.
Figure 2B:
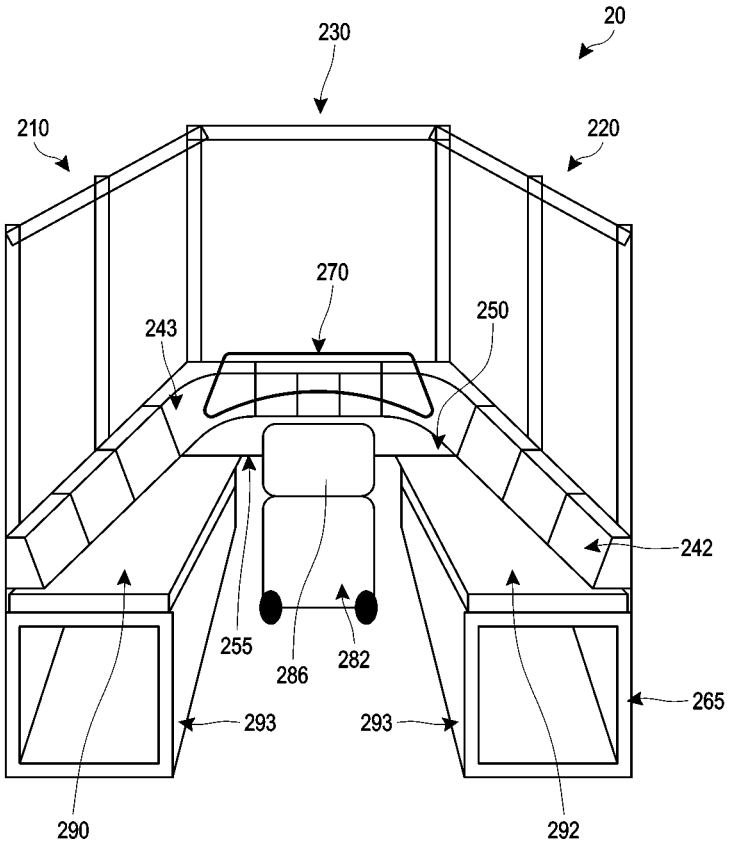
FIG. 2B schematically illustrates a front perspective view of an example dual-function work cubicle in a work mode.
Figure 3A:
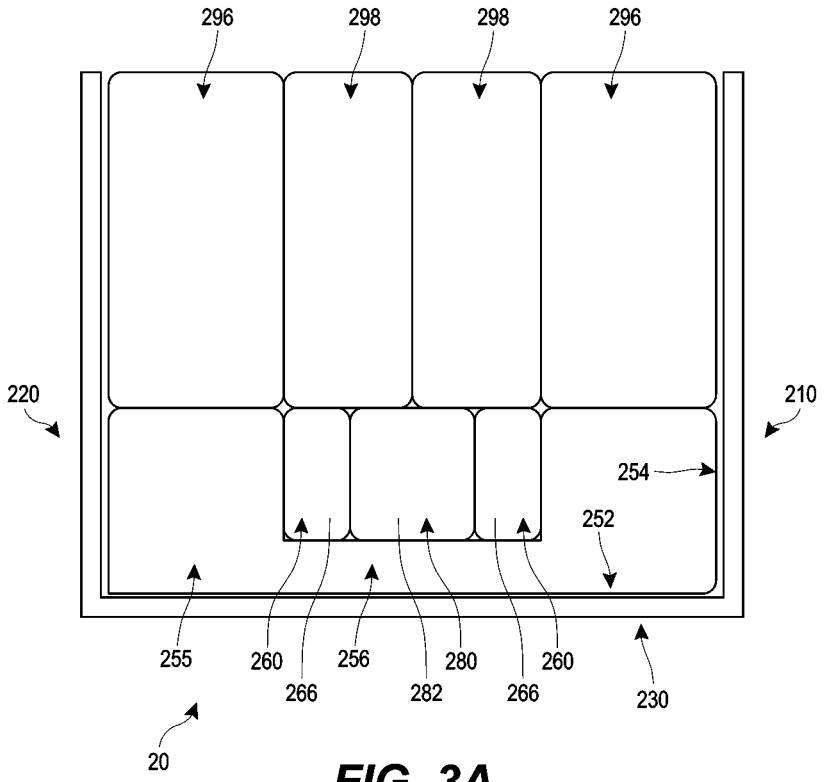
FIG. 3A schematically illustrates a top view of the dual-function work cubicle of FIG. 2A in an exercise mode.
Figure 3B:
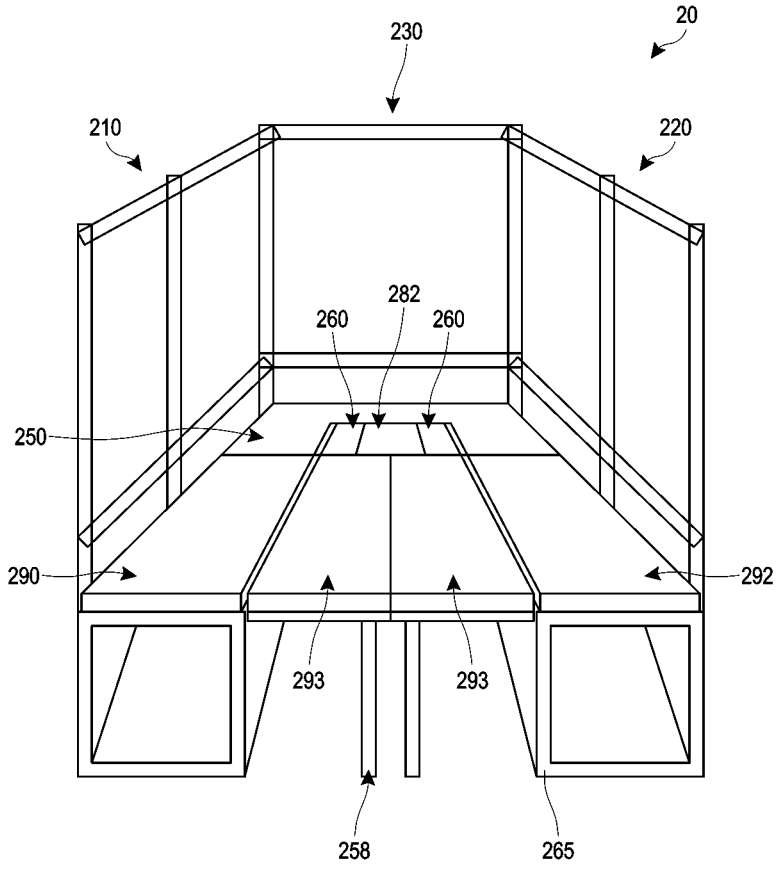
FIG. 3B schematically illustrates a front perspective view of the dual-function work cubicle of FIG. 2B in an exercise mode.

FIGS. 2A-2B and 3A-3B illustrate an embodiment of a dual-function work cubicle 20. The cubicle 20 can have any of features of the cubicle 10 described above. Features of the cubicle 20 can be incorporated into features of the cubicle 10. Features of the cubicle 10 can be incorporated into features of the cubicle 20. FIGS. 2A and 2B illustrate the cubicle 20 in a work mode. FIGS. 3A and 3B illustrate the cubicle 20 in an exercise mode.

In some embodiments, a portion of the floor 200 enclosed by the cubicle 20 can have a width of between about 5 feet to about 10 feet. In some embodiments, such as illustrated in FIGS. 2A-2B and 3A-3B, the cubicle 20 can have an internal width of about 8 feet. In some embodiments, the floor portion 200 enclosed by the cubicle 20 can have a length or depth of between about 5 feet to about 10 feet. In some embodiments, such as illustrated in FIGS. 2A-2B and 3A-3B, the cubicle 20 can have an internal length or depth of about 7 feet.

Figure 4:
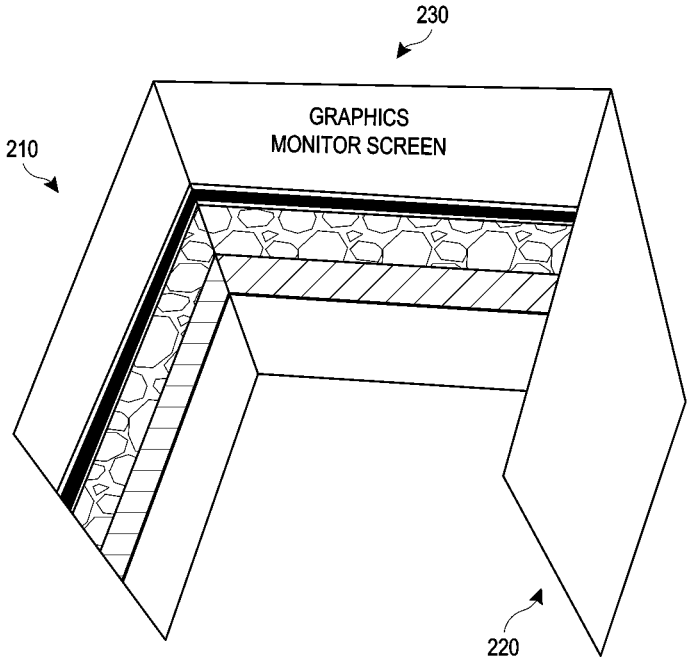
FIG. 4 schematically illustrates a top perspective view of a plurality of vertical dividers of an example dual-function work cubicle.

The cubicle 20 can have one or more vertical dividers defining boundaries of the enclosed floor 200. In some embodiments, the cubicle 20 can have a first divider 210 and a second divider 220. In some embodiments, such as schematically illustrated in FIGS. 2A-2B and 3A-3B, the cubicle 20 can have an intermediate divider 230 between the first divider 210 and the second divider 220. The cubicle 20 can have an entrance 240 between the first and second dividers 210, 220 and can be opposite the intermediate divider 230. In some embodiments, the dividers 210, 220, 230 of cubicle 20 can have a height of between about 3 feet to about 8 feet. In some embodiments, such as illustrated in FIGS. 2A-2B and 3A-3B, the dividers 210, 220, 230 of cubicle 20 can have a height of about 7 feet. FIG. 4 schematically illustrates the dividers 210, 220, 230. In some embodiments, the dividers 210, 220, 230 can be connected. In some embodiments, the dividers 210, 220, 230 can be a single structure foldable along two hinges.

The cubicle 20 can have a bench 250 with a substantially flat top surface 256. The top surface 256 can have two sides forming an angle. In some implementations, such as illustrated in FIGS. 2A-2B and 3A-3B, the bench 250 can be U-shaped. The bench 250 can have a long side 252 and a short side 254. Two ends of the U-shape can be on the short side 254. In some embodiments, the long side 252 of the bench 250 can substantially occupy an entirety of the internal width of the cubicle 20. In some embodiments, such as shown in FIGS. 2A-2B and 3A-3B, the long side 252 of the bench 250 can be about 8 feet in length. The short side 254 of the bench 250 can have a length of about 20 inches to about 40 inches. In the illustrated embodiments, the short side 254 of the bench 250 can be about 28 inches in length. The bench 250 can be positioned near or adjacent the intermediate divider 230. The long side 252 can align generally with the intermediate divider 230. The short side 252 can align generally with the first and second divider 210, 220. In some implementations, the bench 250 can be secured to the intermediate divider 230, the first divider 210, and/or the second divider 220 with fastener(s) described above. In some embodiments, the U-shaped bench 250 can comprise an integral single structure. In some embodiments, the bench 250 can comprise a plurality of sections releasably coupled to form the U-shape.

The bench 250 can comprise a top slab 255 having a substantially flat top surface 256. As shown in FIG. 3A, the top slab 255 can be generally U-shaped. The slab 255 can be supported by a bench frame 265. The height of the top surface 256 can be between about 15 inches to about 35 inches, or about 20 inches. The top surface 256 can have internal edges along the long and short sides 252, 254 to form the U-shape. The internal edge along the short side 254 can have a length of between about 15 inches to about 25 inches, or about 20 inches. The internal edge along the long side 252 can have a length of between about 20 inches to about 50 inches, or about 40 inches.

The bench 250 can have one or more platforms 260. The platform 260 can be hingedly coupled to the top slab 255 via at least one hinge (such as described above) at one or both of the internal edges along the short side 254 of the bench 250. In the illustrated embodiments, the bench 250 can have two hinged platforms 260 each hingedly coupled to one of the internal edges along the short side 254 of the bench 250. The hinged platform 260 can have a substantially flat platform surface 266. As shown in FIG. 3A, the platform 266 can be generally square or rectangular. The platform surface 266 can have a length substantially the same as the internal edges along the short side 254 of the bench 250. In the illustrated embodiment, the platform surface 266 can have a length of about 20 inches. The platform surface 266 can have a width generally parallel to the long side 252 of the bench 250. The width of the platform surface 266 can be between about 5 inches to about 15 inches. In the illustrated embodiment, the width of the platform surface 266 can be about 10 inches.

The hinged platform 260 can be configured to rotate between a retracted position and an extended position. FIGS. 2A and 2B schematically illustrate the hinged platform 260 in the retracted position (such as described above). A volume below the top slab 255 can be configured as storage space. FIGS. 3A and 3B schematically illustrate the hinged platform 260 in the extended position (such as described above). The platform 260 can have a plurality of (such as two) legs supporting the platform 260 in the extended position. In some embodiments, the plurality of legs of the platform 260 can be folded under the platform 260 in the retracted position.

As shown in FIGS. 3A and 3B, a space between the two hinged platforms 260 in the extended position can bound a cockpit area 280. The cockpit area 280 can have a width of between about 15 inches to about 25 inches generally parallel to the long side 252 of the bench. In the illustrated embodiments, the width of the cockpit area 280 can be about 20 inches. The cockpit area 280 can have substantially the same length as the hinged platform 260. The cockpit area 280 can be configured to accommodate a chair 282. The chair 282 can have substantially the same as, or slightly smaller, dimensions as the cockpit area 280. The chair can have a chair seat and a chair back. When in the work mode, the chair back can be in an upright position and a chair back surface 286 can be generally perpendicular to the chair seat. When in the exercise mode, the chair back can be configured to fold onto the chair seat and the chair back surface 286 can be generally parallel to the floor 200. As shown in FIG. 3B, the chair back surface 286, when folded, can have substantially the same height as the bench top surface 256 and/or the platform surfaces 266 in the extended position. In some embodiments, in the exercise mode, first and second of the platforms 260 and a surface of the chair (e.g., the back surface 286) are generally flush and/or occupy substantially the entire cockpit area 280. In certain variants, in the exercise mode, first and second of the platforms 260 are generally flush and/or occupy substantially the entire cockpit area 280. For example, a distal edge (e.g., an edge opposite a hinged edge) of each platform 260 can engage (e.g., abut) another of the platforms 260.

The cubicle 20 can have a first side bench 290 and a second side bench 292. The first and second side benches 290, 292 can each be positioned adjacent to and/or can extend from the bench 250. For example, as shown in FIGS. 2A and 2B, the benches 290, 292 can extend from a free end of the generally U-shaped bench 250 along the short side 254. The first and second side benches 290, 292 can extend generally along the first or second divider 210, 220, respectively. As shown in FIGS. 2A-2B and 3A-3B, the first and second side benches 290, 292 can extend to or near the entrance 240.

The first and second side benches 290, 292 can have side bench top surfaces 296. The side bench top surface 296 can have a length along the first and second dividers 210, 220. The length of the side bench top surface 296 can be about 35 inches to about 105 inches. In some embodiments, such as shown in FIGS. 2A-2B and 3A-3B, the length of the side bench top surface 296 can be about 54 inches or about 56 inches. The side bench top surface 296 can have a height substantially the same as the top surface 256 of the bench 250.

The first and second side benches 290, 292 can have hinged side platforms 293. The side platform 293 can be hingedly coupled to the first or second side benches 290, 292. The side platform 293 can have a retracted position and an extended position, such as described above regarding the hinged platforms 260. FIGS. 2A and 2B illustrate the side platforms 293 in the retracted position. Spaces below the first and second side benches 290, 292 can be configured to provide storage space. FIGS. 3A and 3B illustrate the side platforms 293 in the extended position. The side platform 293 can have a side platform surface 298 having a length substantially the same as the length of the side bench top surface 296. The side platform surface 298 can have a width of about 15 inches to about 25 inches. In the illustrated embodiments, the width of the side platform 293 can be about 20 inches. As shown in FIGS. 3A and 3B, the side platforms 293 in the extended position can extend substantially a space between the side bench top surfaces 296. This can provide a substantially continuous and/or substantially flat surface between the side and top surfaces 296. As shown in FIG. 3B, the side platform 293 can have a plurality of (such as two) legs 258 supporting the side platform 293 in the extended position. In some embodiments, the plurality of legs 258 of the side platform 293 can be folded under the side platform 293 in the retracted position.

As shown in FIGS. 3A and 3B, the top surface 256, the platform surfaces 266, the chair back surface 286, the side bench top surfaces 296, and the side platform surfaces 298 can form a workout surface 264 of approximately the same height. The workout surface 264 can be configured to provide a platform for the user to exercise, such as stretching, yoga, Pilates, or otherwise. In some embodiments, the bench 250 and the first and second side benches 290, 292 can comprise a single bench. The platforms 260 and the side platforms 293 can be rotated between the extended and retracted positions independently or simultaneously.

As also shown in FIGS. 3A and 3B, the top surface 256, the platform surfaces 266, the chair back surface 286, the side bench top surfaces 296, and/or the side platform surfaces 298 can have substantially the same height, and/or have small or no gaps therebetween. This configuration can allow the workout surface 264 to be substantially flat and/or continuous. The workout surface 264 can be elevated from the floor 200, which can promote ventilation and a sense of power. In some embodiments, the workout surface 264 can extend between the dividers 210, 220. In some embodiments, the workout surface 264 can occupy substantially the entire footprint of the cubicle 20.

As shown in FIGS. 2A and 2B, the cubicle 20 can have a desk-top 270. The desk-top 270 can be installed on the divider 230. The desk-top 270 can have an extended position and a stowed position (such as described above). The desk-top 270 can be rotated about its long side away from or toward the divider 230 to move between the extended or stowed positions. In some embodiments, in the stowed position, the desk-top 270 can be substantially flush with and/or substantially parallel with the divider 230. FIGS. 2A and 2B schematically illustrate the desk-top 270 in the extended position. FIGS. 3A and 3B schematically illustrate the desk-top 270 in the stowed position. In some embodiments, the desk-top 270 can be installed on the divider 210 or 220 and is rotatable about its short side to move between the extended and stowed positions. In some embodiments, the desk-top 270 can comprise two sections installed on the divider 210 and the divider 220, respectively. The sections can be moved between the stowed position and the extended position independently or simultaneously. In some embodiments, the desk-top 270 can be at a sitting height when in the extended position, such as about 36 inches above the floor 200. In some embodiments, the desk-top 270 can be configured to be a standing desk. In some embodiments, the height of desk-top 270 is adjustable to allow the desk-top 270 to be suitable for use when a user is sitting or standing.

In some embodiments, such as shown in FIG. 4, a mounting feature for the desk-top 270 on the divider 230, such as a mounting bracket or hinges, can be above the bench top surface 256, such as at least about 28 inches about the bench top surface 256. As also shown in FIG. 4, the divider 230 of the cubicle 20 can be configured to mount a computer monitor screen. In some embodiments, the monitor screen can be mounted on the first or second divider 210, 220. The monitor screen can be mounted above the desk-top 270 when the desk-top 270 is in the extended position. In some embodiments, the monitor screen can have a flat screen. In some implementations, an angle of the monitor screen can be adjustable.

The cubicle 20 can include a plurality of cushions 242. The cushions 242 can be placed on the bench top surface 256 and/or the side bench top surface 296 along one or more dividers 210, 220, 230. In some embodiments, such as shown in FIGS. 2A and 2B, the plurality of cushions 242 can be placed along substantially an entirety of the dividers 210, 220, 230 in the work mode. In some embodiments, the cushions 242 can have a thickness of about 10 inches or about 18 inches that extends generally parallel to the bench top surface. In some embodiments, such as shown in FIG. 4, the cushions 242 can have a height of about 18 inches or about 10 inches. As shown in FIGS. 2A and 2B, the cubicle 20 can include one or more corner cushions 243 that can be bigger than the cushions 242. The cushions 242 can provide back support for people sitting on the side bench top surfaces 296 and/or the bench top surface 256. The cushions 242 can be removed, for example, stored underneath the bench 250 and/or the side bench 290, 292 in the exercise mode. Removing the cushions 242 can increase a surface area of the workout surface 264.

In some embodiments, such as shown in FIGS. 2A and 2B, the cubicle 20 is in the work mode. The desk-top 270 can be in the extended position configured to provide a surface for performing work tasks, such as writing, typing, reviewing documents, and/or otherwise. The desk-top 270 can extend over at least a portion of the bench top surface 256. The hinged platforms 260 and the side platforms 293 can be in the retracted position. The side bench top surfaces 296 and at least a portion of the bench top surface 256 can be configured to provide seating, for example, for visitors. The hinged platforms 260 and the side platforms 293 can provide leg rest for a person sitting on the bench 250 and/or the first and/or second side benches 290, 292. The user and/or visitors can move around in the cubicle 20, and/or can sit and/or stand next to the desk-top 270. The chair 282 can be moved around in the cubicle, for example, using wheels. The dividers 210, 220, 330 can provide privacy and/or reduce distractions to the user during the work mode.

In some embodiments, such as shown in FIGS. 3A and 3B, the cubicle 20 is in the exercise mode. The hinged platforms 260 and the side platforms 293 can be in the extended position and the chair back can be folded down inside the cockpit area 280, forming the workout surface 264. In some embodiments, the workout surface 264 can cover substantially an entirety of the enclosed floor portion 200. In some embodiments, the side bench top surfaces 294 and the side platform surface 298 in the extended position can extend to or near the entrance 240. The desk-top 270 can be in the stowed position and out of the way of the user when the user exercises on the workout surface 264. The dividers 210, 220, 230 can provide privacy and/or reduce distractions to the user during the exercise mode.

The cubicle 20 can be configured to readily convert from the work mode to the exercise mode. The conversion process can be quick, such as taking less than about: 1 minute, 2 minutes, 3 minutes, 5 minutes, or other time periods. The conversion process can be convenient for the user, such as not requiring the user to travel away from their work area and/or to lift heavy objects. A quick and convenient conversion can facilitate and encourage exercise by the user. For example, when the user is feeling stressed and/or wants to take a break from work, the user can quickly and conveniently convert the cubicle 20 to the exercise mode to exercise and/or rest, and then quickly and conveniently convert the cubicle 20 back to the work mode.

In some embodiments, the conversion process includes stowing the desk top 270, folding down the chair inside the cockpit area 280, and pulling the hinged platforms 260 and the side platforms 293 to the extended position. In some embodiments, the conversion process includes securing the hinged platforms 260 and/or the side platforms 293, such as with the leg, latch, or other securing member. In some variants, the hinged platforms 260 and/or side platforms 293 automatically lock into place upon being placed in the extended position. For example, pivotable legs can automatically engage to support the platforms 260, 293. In some implementations, table leg braces (or other bracing mechanisms) automatically engage to support the platforms 260, 293. Certain variants do not require a user to manually engage a locking member (e.g., a latch, brace, or otherwise) to secure the hinged platforms 260 and/or side platforms 293.

In some implementations, the bench 250 can have an L-shape with one hinged platform along its short side. The cubicle 20 can have a cockpit area when the hinged platform is in the extended position. The cubicle 20 can be without a cockpit area as the hinged platform in the extend position can extend substantially to or near a free end of the long side of the bench 250. The cubicle 20 can have one side bench 290 extending from the short side of the bench 250. In the exercise mode, the bench top surface, the hinged platform surface, the side bench top surface, and the side platform surface can form the workout surface. In some variants, the bench top surface, the hinged platform surface, the side bench top surface, the side platform surface, and the chair back surface can form the workout surface.

Certain Dual-Function Work Cubicles with External Exercise Equipment

Figure 5:
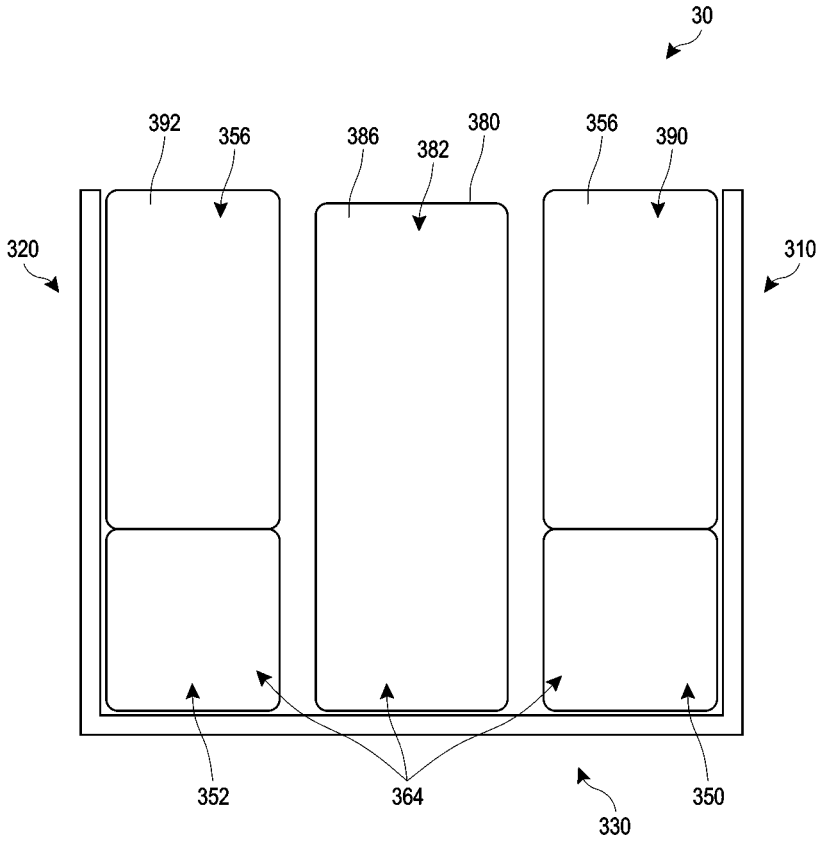
FIG. 5 schematically illustrates a top view of an example dual-function work cubicle including a Pilates table.

FIG. 5 illustrates an embodiment of a work cubicle 30. The cubicle 30 can have the features of the cubicles 10, 20 described above. Features of the cubicles 10, 20 can be incorporated into features of the cubicle 30. Features of the cubicle 30 can be incorporated into features of the cubicles 10, 20. FIG. 5 illustrates the cubicle 30 in an exercise mode.

The cubicle 30 can have a first side bench and a second side bench. The first and second side benches can each flank a first or second divider 310, 320. The first and second side benches can each have a length substantially the same as an internal length or depth of the cubicle 30. In the illustrated embodiment, the internal length or depth of the cubicle 30 can be about 84 inches or about 86 inches. The first and second side benches can each have a width of about 15 inches to about 35 inches, or about 28 inches. The first and second side benches can have a height of about 20 inches. In some implementations such as shown in FIG. 5, the first and second side benches can each comprise a first sectional 350, 352 and a second sectional 390, 392. The first sectional 350, 352 can have a length of about 28 inches. The second sectional 390, 392 can have a length of about 54 inches or about 56 inches.

The first and second side benches can bound a space 380 therebetween. The space 380 can have a length of about 40 inches and a width of about 84 inches or about 86 inches. In some embodiments, in an exercise mode of the cubicle 30, the space 380 can accommodate a Pilates table 382. The Pilates table 382 can have a Pilates table surface 386 having substantially the same or slightly smaller dimensions as a cross section of the space 380. The Pilates table surface 386 can have a width of between about 25 inches to about 39 inches. In the illustrated embodiment, the Pilates table surface 386 can have a length of about 81 inches and a width of about 29 inches. Gaps between the Pilates table 382 and the first and second side benches can facilitate insertion and/or removal of the Pilates table 382 into and/or from the space 380. The Pilates table surface 386 can have substantially the same height as top surfaces 356 of the first and second side benches. The Pilates table surface 386 and the top surfaces 356 can form a workout surface 364. The Pilates table surface 386 can be at a greater or smaller height than top surfaces 356 of the first and second side benches.

In some embodiments, the Pilates table 382 can comprise trapeze features, such as loops, slings, springs, hand and/or foot straps, and/or otherwise. In some embodiments as described in greater detail below, the cubicle embodiments can comprise a support frame configured to cooperate with the trapeze features.

In some implementations, the space 380 can accommodate other types of exercise equipment. For example, the space 380 can accommodate a rowing machine or ergometer. The rowing machine or ergometer can have a folded configuration and an unfolded configuration. In some embodiments, a locking feature (for example, a locking pin) can lock the rowing machine into the unfolded configured and can be removed to allow the rowing machine to be folded. The folded configuration can have a more compact outer shape than the unfolded configuration. When folded, the rowing machine can be hung on a wall in the office or on one divider 310, 320, 330. To use the rowing machine, the folded rowing machine can be rolled into the space 380. The rowing machine can be snapped into place with a locking feature in the cubicle 30, for example, on the floor 300, before being unfolded. In some embodiments, the space 380 can be configured to receive a treadmill, a stationary bike, and/or an elliptical machine.

Although not visible from the top view in FIG. 5, the first sectional 350, 352 and/or the second sectional 390, 392 can have one or more hinged platforms. The platforms can be configured to move between a retracted position and an extended position individually, or simultaneously. The platforms can be in the retracted position when the space 380 of the cubicle 30 accommodates the Pilates table 382, the rowing machine, and/or other exercise equipment in the exercise mode. The user can stow a desk-top in the cubicle 30 (such as described above) and move in the exercise equipment to convert the cubicle 30 from the work mode to the exercise mode. One or more platforms can be moved to the extended position if the user does not use the exercise equipment or use a smaller piece of equipment that may not substantially occupy an entirety of the space 380. The platform surfaces and the bench top surfaces 356 can form the workout surface 364.

Certain Accessories of Some Dual-Function Work Cubicles

The cubicle embodiments disclosed can have one or more attachments and/or features described below.

Figure 6:
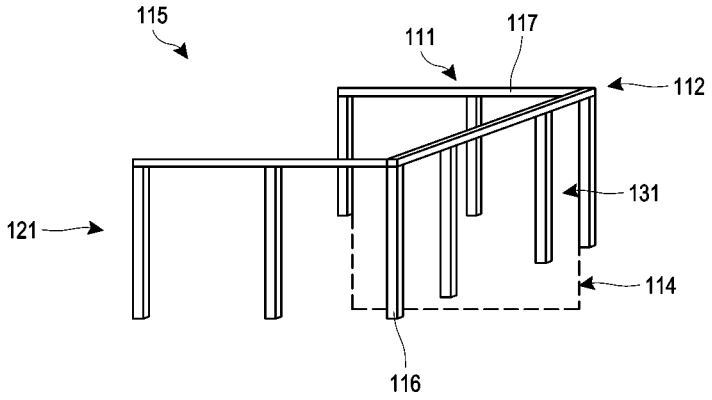
FIG. 6 schematically illustrates a side perspective view of a support framework of an example dual-function work cubicle.

FIG. 6 illustrates an embodiment of a support frame 115. The support frame 115 can be incorporated in the cubicle embodiments described. The support frame 115 can be configured to support trapeze features and/or other strength or flexibility training features. For example, the frame 115 can support and/or connect to ropes or pulley of a Pilates table. The trapeze features can be supported by one or more bars of the support frame 115. In some embodiments, the support frame 115 can include one or more chin-up bars. In some embodiments, the support frame 115 can provide anchoring location(s) for resistance band(s). In some embodiments, the support frame 115 can include one or more back rollers. The support frame 115 can provide perimeter structures to bolster and/or support an overhead system with multiple points to attach strength and/or flexibility exercise tools and/or accessories.

The support frame 115 can have a first side 111, a second side 121, and an intermediate side 131 between the first and second sides 111, 121. The support frame 115 can have a shape and dimensions generally similar to and/or tracking the shape and dimension of a top portion of the first, second, and intermediate dividers. The first, second, and intermediate sides 111, 121, 131 can have a plurality of vertical bars 116 extending along the height of the dividers. The first, second, and intermediate sides 111, 121, 131 can have a plurality of horizontal bars 117 connecting the vertical bars 116 along the first, second and intermediate sides 111, 121, 131 at a top end 112 of the support frame 115. In some variants, the support frame 115 can include one or more horizontal bars extending between the horizontal bars 117 of the first and second sides 111, 121, of the first and intermediate sides 111, 131, and/or of the intermediate and second sides 121, 131. In some variants, the support frame 115 can include one or more horizontal bars connecting the vertical bars along the first, second and intermediate sides 111, 121, 131 at a height between the top end 112 and a lower end 114 of the support frame 115. In some variants, the support frame 115 can include one or more bars at an angle.

Figure 7A:
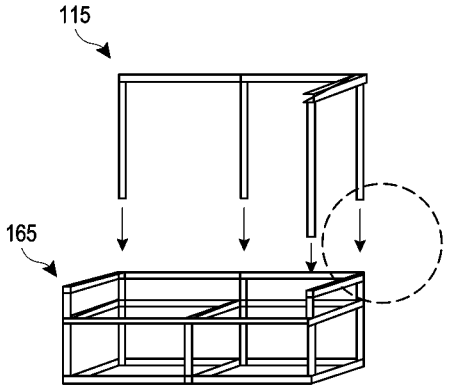
FIGS. 7A and 7B schematically illustrate a side perspective view of a portion of a support framework and a bench framework of an example dual-function work cubicle, without or with pads, respectively.
Figure 7B:
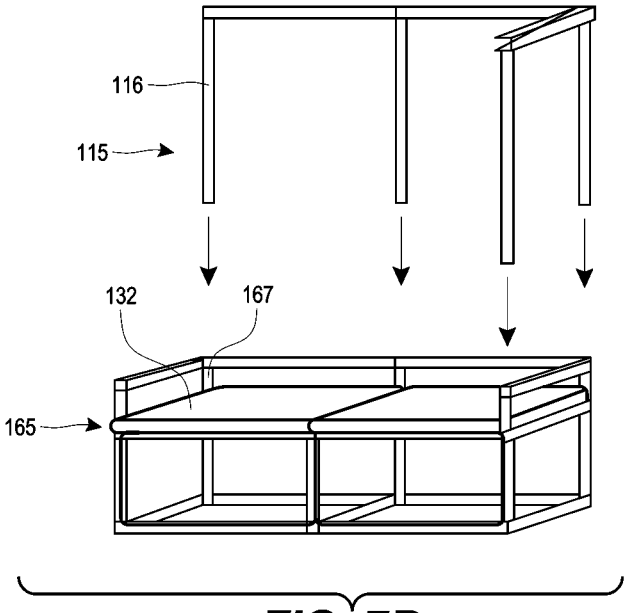

As shown in FIGS. 7A and 7B, the vertical bars 116 of the support frame 115 can be coupled to the bench frame 165. The bench frame 165 can have a generally lattice structure. The bench frame 165 can provide structural support and rigidity to the bench embodiments described and can provide support and anchoring to the support frame. The strength and/or rigidity of the support frame 115 and/or the bench frame 165 can withstand forces exerted by the user during the exercise, such as when pulling one or more of the trapeze features and/or pushing and pulling on the rowing machine. The bench frame 265 described above can have any of features of the bench frame 165.

Figure 8:
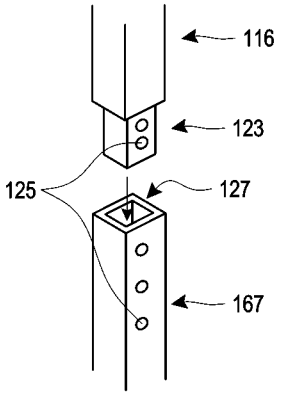
FIG. 8 schematically illustrates a detailed perspective view of certain bars of a support framework and a bench framework.

One or more of the vertical bars 116 of the support frame 115 can be coupled to one or more of the vertical bars 167 of the bench frame 165. FIG. 8 illustrates an example of coupling between the vertical bars 116, 167 of the support and bench frames 115, 165. In the illustrated embodiment, the coupling can comprise a mortise and tenon joint or male and female features. A free end of the vertical bar 116 can have a projection 123. The projection 123 can have reduced cross-sectional dimensions compared to cross-sectional dimensions of the vertical bar 116. A corresponding end of a vertical bar 167 of the bench frame 165 can have a cavity 127 dimensioned to accommodate the projection 123. In some embodiments, the projection 123 and the cavity 127 can have one or more holes 125 configured for securing the projection 123 inside the cavity 127 with bolt(s) and screw (s), and/or pin(s). In some embodiments, the projection 123 or the cavity 127 can have one or more spring-loaded protrusions configured to engage one or more openings on the cavity 127 or the projection 123 to secure the projection 123 inside the cavity 127.

The support frame 115 and/or the bench frame 165 can comprise substantially a rigid material, such as metals or metal alloys. In some embodiments, the support frame 115 and/or the bench frame 165 can comprise a lightweight and rigid material, such as aluminum. In some variants, the horizontal and vertical bars of the support frame 115 and/or the bench frame 165 can be hollow to reduce the weight of the frames. A metal or metal alloy material that is heavier than aluminum, such as stainless steel, can construct the hollow bars of the support frame 115 and/or the bench frame 165.

The bars on the support and/or bench frames 115, 165 can have different or substantially the same outer shape dimensions. In some embodiments, the bars on the support and/or bench frames 115, 165 can have an outer diameter of about three inches. In some embodiments, the bars on the support and/or bench frames 115, 165 can have a square or rectangular cross section.

In some embodiments, such as shown in FIG. 7B, the cubicle embodiments can have one or more compressible or deformable pads 132 covering at least a portion of the workout surface. In some embodiments, the pads 132 can comprise foam pads. In some variants, the foam pads can comprise martial arts dense foam materials. In some implementations, the pads can have a thickness of about one inch to about one and a half inches. The pads can be configured to provide cushioning, protection, comfort, and/or support to the user when exercising on the workout surface. The pads can be configured to provide cushioning, comfort, and/or support to lower bodies of the user and/or others sitting on the benches when the cubicle embodiments are in the work mode. The pads 132 can be stored under the side benches 290, 292 during the work mode.

In some embodiments, the cubicle can include a mattress, such as a twin-sized mattress. The mattress can be rolled up and stowed, for example, under one bench, in the work mode. The mattress can be unrolled and laid over at least a portion of the workout surface. The workout surface can be configured to provide a resting and/or nap surface, and/or an area for meditation, with or without the mattress.

In some embodiments, the cubicle can include one or more benches having a tilted bench top surface. In some implementations, the angle of tilting can be between about 10° to about 45°, or about 35°. The tilted bench top surface can be configured for exercises requiring a sloped surface, for example, spinal decompression exercises.

In some embodiments, the cubicle can include one or more dining and/or coffee table surfaces having an extended position and a stowed position. When in the extended position, the table surface can extend from one divider and can be configured to provide a dining area. When in the stowed position, the table surface can be tucked to or near one divider.

In some embodiments, the cubicle can be configured for home use. The cubicle can include one or more ottomans and/or mounted cabinets outside the cubicle. The ottoman and/or cabinet can have a depth of between about 12 inches to about 24 inches. The cabinet can be a chest of drawers, wardrobes, or otherwise. The ottoman and/or cabinet can increase storage space of the cubicle.

In some embodiments, the cubicle can have a door, such as a sliding door, at the entrance. In some implementations, the cubicle can have a canopy covering an overhead space of the cubicle. The door and/or canopy can promote privacy during the work mode and/or the exercise mode.

In some embodiment, the cubicle can have entertainment and/or productivity features. The cubicle can have media ports, power outlets, and/or lighting installed, for example, on one or more dividers. The medial ports and/or power outlets can allow the cubicle to be used with audio, visual, and/or other electronic technology. The one or more dividers can include visual effects and artwork.

Certain Dual-Function Work Cubicles with Exercise Bars and Other Equipment

FIGS. 10A-10E illustrate an embodiment of a dual-function work cubicle 40. The cubicle 40 can have any of features of the cubicle 10, 20, 30 described above. Features of the cubicle 40 can be incorporated into features of the cubicle 10, 20, 30. Features of the cubicle 10, 20, 30 can be incorporated into features of the cubicle 40.

Figures 10A, 10B:
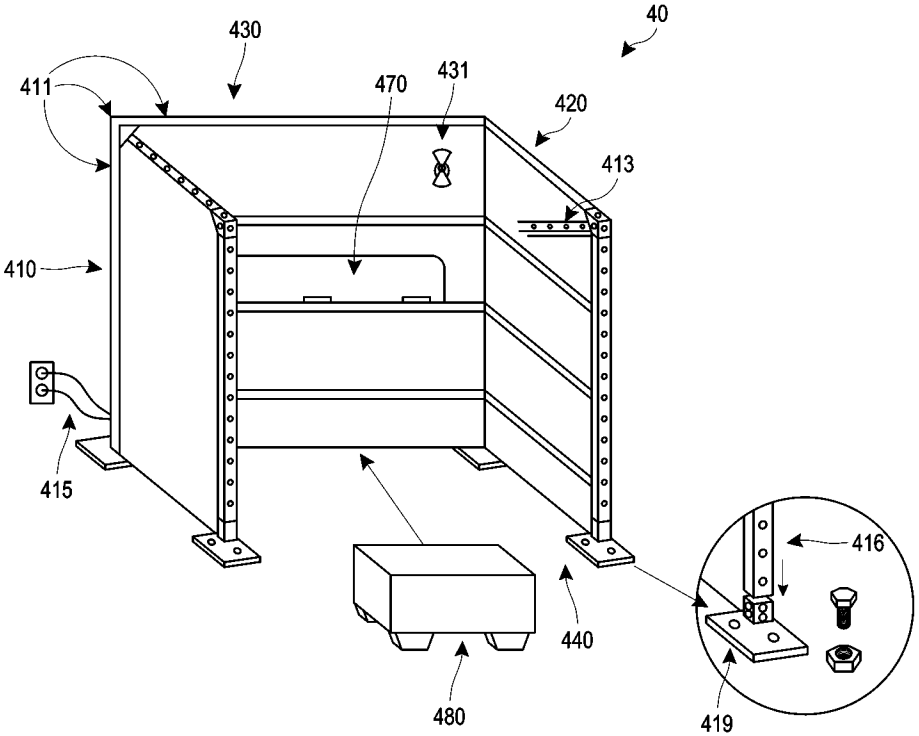
FIG. 10A schematically illustrates a front perspective view of another example dual-function work cubicle in an exercise mode.
FIG. 10B schematically illustrates a detailed view of a panel post base of the cubicle of FIG. 10A.

The cubicle 40 can have one or more vertical dividers or panels defining boundaries of a partially enclosed floor portion. In some embodiments, the cubicle 40 can have a first panel or divider 410, a second panel or divider 420, and a third panel or divider 430. In some embodiments, such as schematically illustrated in FIG. 10A, the third panel 430 can be between the first panel 410 and the second panel 420. The cubicle 40 can have an entrance 440 between the first and second panels 410, 420 and opposite the intermediate panel 430.

In some embodiments, the panels 410, 420, 430 of cubicle 40 can have a height of between about 3 feet to about 8 feet, or about 7 feet, about 7'6", or otherwise. In some embodiments, the panels 410, 420, 430 of cubicle 40 can have a width of between about 5 feet to about 7 feet, or about 6 feet. The panels 410, 420, 430 can be connected. In some embodiments, the panels 410, 420, 430 can be a single structure foldable along two hinges.

The panels 410, 420, 430 can have support rails 411. The support rails 411 can comprise struts. The rails 411 can include horizontal rails, vertical rails, and/or cross-member rails 413 extending at an angle. The cross-member rails 413 can be used, for example, for supporting a pull-up bar 437, for hanging privacy curtains, or otherwise. In some embodiments, such as shown in FIG. 10A, electrical wires 415 can be fit into one or more the support rails 411. The wires 415 can connect the computer, lighting (such as clip light(s) 431 shown in FIGS. 10A and 10D), or other electronic equipment.

As shown in FIG. 10B, a lower end 416 of a vertically extending rail of the panels 410, 420, 430 can be coupled to a post base 419 with fasteners (such as bolts through holes on the lower end 416 of the rail and the post base 419 or otherwise). In some embodiments, the post base 419 can be secured (e.g., bolted) to the floor to secure the cubicle 40 to the floor. In some embodiments, the cubicle 40 can include four post bases 419. In some variants, the panels 410, 420, 430 can be combined with other panels to form a cubicle work space, such as an open cubicle.

Figure 10C:
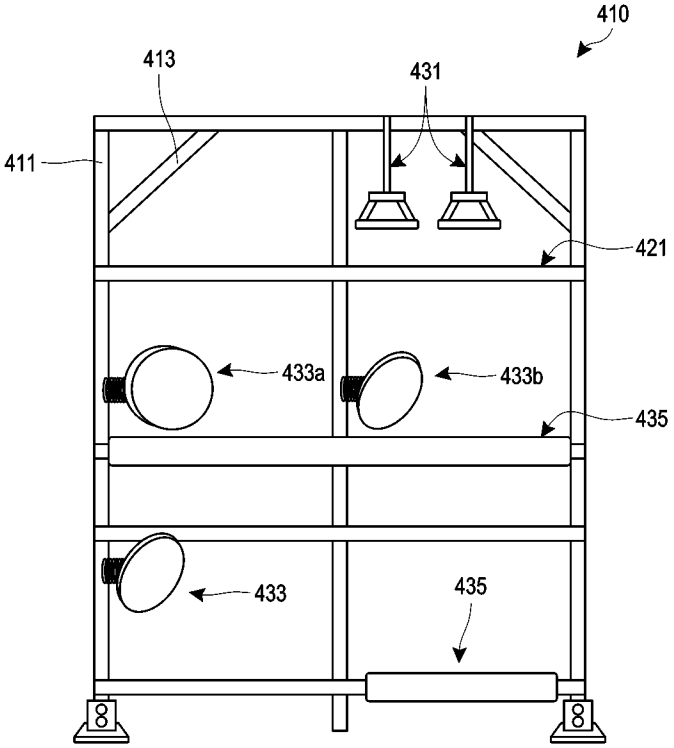
FIG. 10C schematically illustrates an inner-facing side of a first panel of the cubicle of FIG. 10A.
Figure 10D:
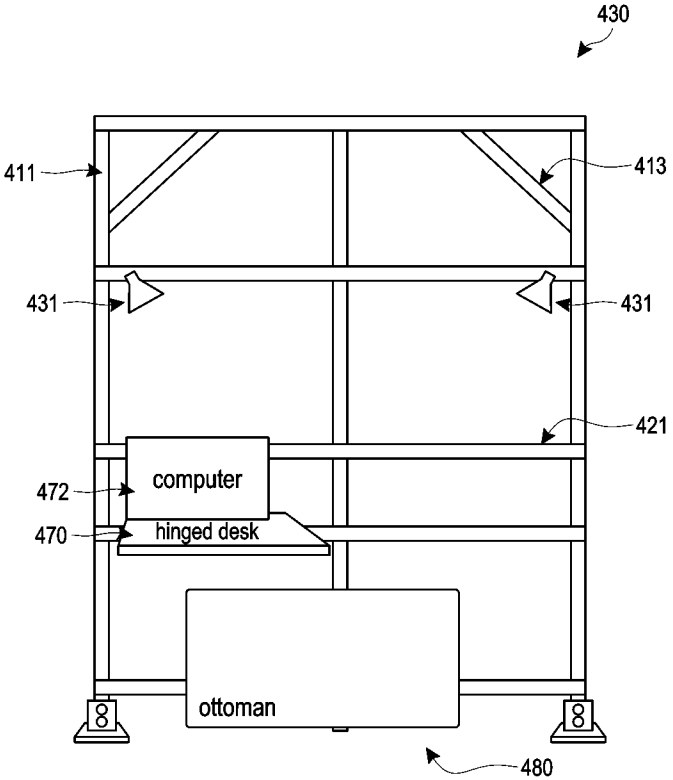
FIG. 10D schematically illustrates an inner-facing side of a third panel of the cubicle of FIG. 10A.

As shown in FIGS. 10A and 10D, the cubicle 40 can have a desk-top 470. The desk-top 470 can be installed on the panel 430. The desk-top 470 can have an extended position and a stowed position (such as described above). The desk-top 470 can be rotated about its long side away from or toward the panel 430 to move between the extended or stowed positions. In some embodiments, in the stowed position, the desk-top 470 can be substantially flush with and/or substantially parallel with the panel 430. FIG. 10A schematically illustrates the desk-top 270 in the stowed position. FIG. 10D schematically illustrates the desk-top 470 in the extended position. In some embodiments, the desk-top 470 in its extended position can support a computer. In other embodiments, such as shown in FIG. 10D, a computer screen 472 can be mounted behind the desk-top 470. In some embodiments, the desk-top 470 can be at a sitting height when in the extended position, such as about 36 inches above the floor. In some embodiments, the desk-top 470 can be configured to be a standing desk. In some embodiments, the height of desk-top 470 is adjustable to allow the desk-top 470 to be suitable for use when a user is sitting or standing.

An ottoman 480 can be moved into the cubicle 40. The ottoman 480 can function as a chair when the cubicle 40 is in the work mode, such as shown in FIG. 10D. When the cubicle 40 is in the exercise mode, the ottoman 480 can be moved away from the cubicle 40 or be used for exercising inside the cubicle 40. In some embodiments, the ottoman 480 can have a width of about 3 feet to about 4 feet, and a height of about 3 feet to about 4 feet, or other dimensions suitable for use inside the cubicle 40. In some embodiments, the ottoman 480 can be a heavy-duty ottoman (such as being suitable to support the weight of a user exercising on the ottoman).

Figure 10E:
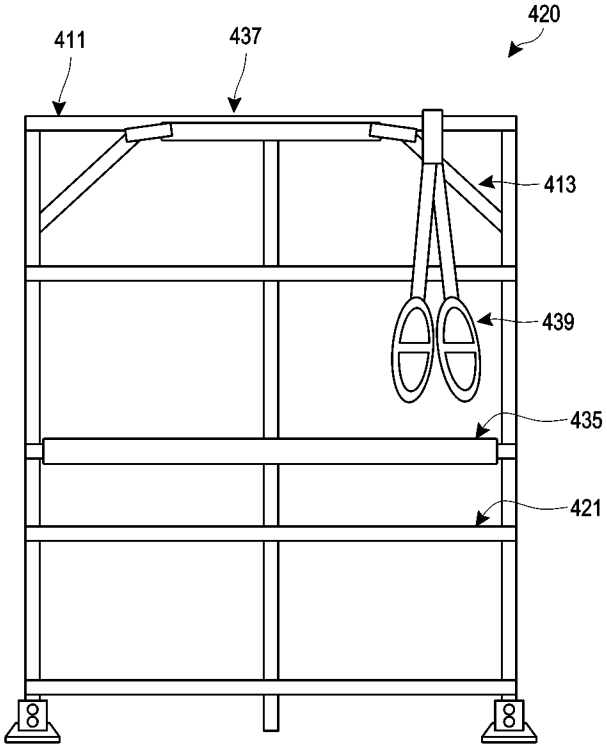
FIG. 10E schematically illustrates an inner-facing side of a second panel of the cubicle of FIG. 10A.

As shown in FIGS. 10C-10E, the panels 410, 420, 430 can include a plurality of bars 421. The bars 421 can extend generally transversely between vertical support rails 411. The bars 431 can be used to, for example, attach resistance band and/or tubes 431 for stretching (such as stretching a user's arms, legs, or other parts of the body), other exercise equipment disclosed, such as padded targets with springs 433 (which can include straight on kick targets 433*a*, angled targets 433*b*, etc., and can be used for karate kicks, boxing, or otherwise), suspension training equipment (e.g., TRX straps 439). Certain bars 431 can be padded with a padding material 435, such as for sit-ups, stretching, or otherwise. The equipment and bars in FIGS. 10C-10E are for illustration and can be mounted on the panels 410, 420, 430 at the bars 421 and/or rails 411.

Certain Multi-Function Chairs

Figure 9B:
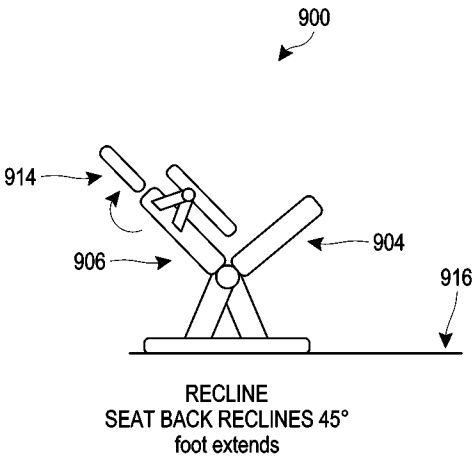
FIG. 9B schematically illustrates the chair of FIG. 9A in a reclined configuration.
Figure 9A:
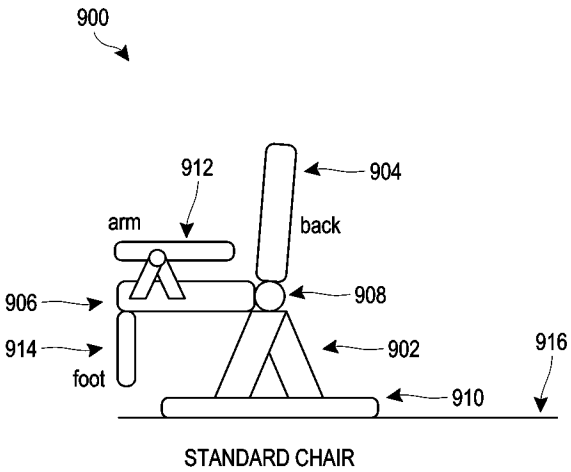
FIG. 9A schematically illustrates an example multi-function convertible chair.

FIG. 9A schematically illustrates an example multi-function convertible chair 900. The chair 900 can have a base frame 902. The base frame 902 can have a first end with a 908 joint (such as a rotatable joint) for connecting a back 904 and a seat 906. The base frame 902 can have a second end with a support surface contacting portion 910. The support surface contacting portion 910 can have an outer dimension that is larger than a remainder of the base frame 902. The larger outer dimension can improve stability of the chair in various configurations, some of which are described below. In some embodiments, the support surface contacting portion 910 can have an outer dimension such that a center of gravity of the chair 900 in its various configurations (and in some embodiments, including a user using the chair configuration for its intended purpose) does not extend outside the support surface contacting portion 910. This can reduce the chair 900 tilting or toppling.

In some embodiments, such as shown in FIG. 9A, the back 904 and the seat 906 can be substantially perpendicular when the chair 900 is in an upright chair arrangement. The seat 906 can be generally parallel to a support surface 916 (for example, a floor surface, a carpet surface, or others). The back 904 can be generally perpendicular to the support surface 916. An arm rest 912 can extend above the seat 906 (for example, on two sides of the seat extending from the joint 908. A foot rest 914 can be connected (for example, rotatably connected) to the seat 906 at a side of the seat 906 opposite the joint 908. The foot rest 914 can be substantially perpendicular to the seat 906 when the chair is intended to function as a standard chair.

In some embodiments, such as shown in FIG. 9B, the chair 900 can be converted to a reclined configuration. The back and the seat 906 can be rotated about 45° so the seat 906 and/or the back 904 can be at about 45° relative to the support surface 916. The back 904 and the seat 906 can remain at substantially the same relative position in FIG. 9A. In some embodiments, the relative positions of the back 904 and the seat 906 can be varied when the chair 900 is in the reclined configuration. In some embodiments, the footrest 914 can be rotated away from the seat 906 such that the foot rest 914 can be generally collinear with the seat 906. A user can rest on the reclined chair 900 (for example, for taking a nap, reading, or others).

Figures 9C, 9D, 9E, 9F:
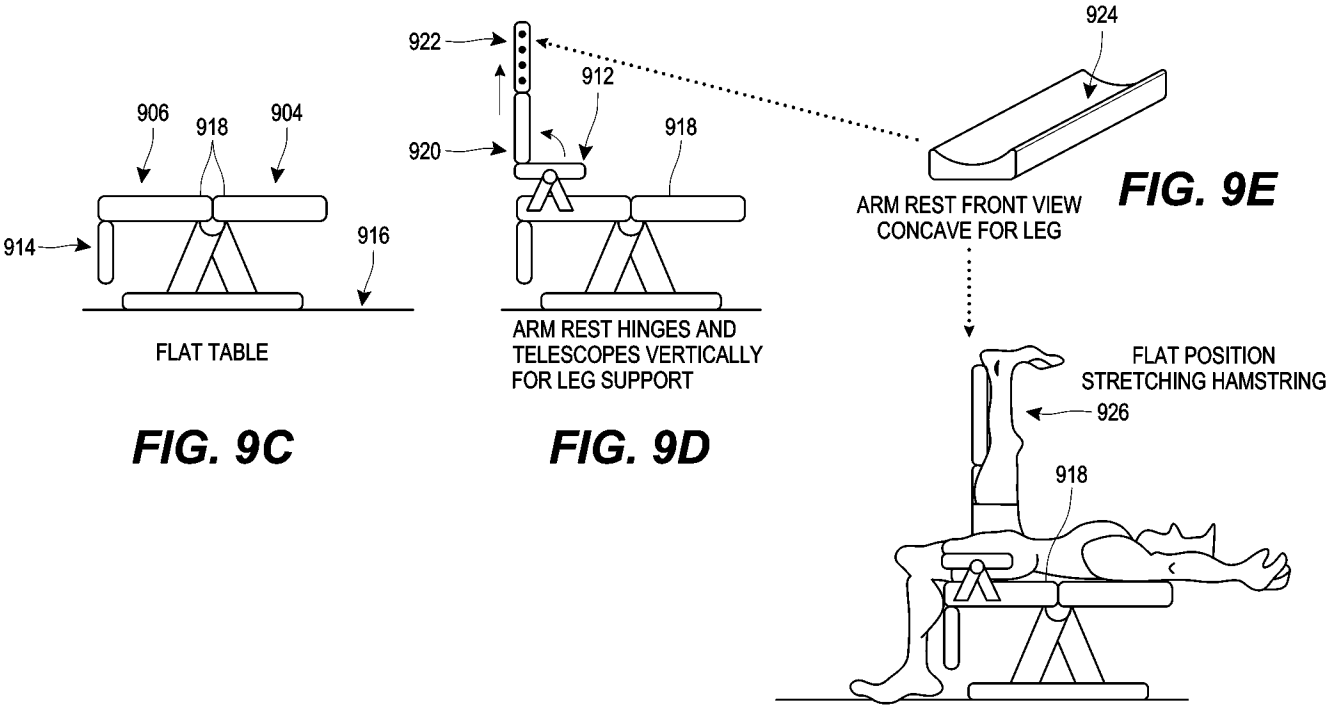
FIG. 9C schematically illustrates the chair of FIG. 9A in a flattened configuration.
FIG. 9D schematically illustrates the chair of FIG. 9A in a flattened configuration with one or more extended arm rests.
FIG. 9E schematically illustrates a perspective front view of a portion of the arm rest of the chair of FIG. 9D.
FIG. 9F schematically illustrates a user using the chair of FIG. 9D.

In some embodiments, such as shown in FIG. 9C, the chair 900 can be converted to a flattened configuration. The back 904 and the seat 906 can be rotated about the joint 908 such that the back 904 and the seat 906 are generally collinear with each other and/or generally parallel to the support surface 916. Surfaces of the back 904 and the seat 906 facing away from the support surface 916 can form a substantially flat surface 918. In some embodiments, such as shown in FIG. 9C, the foot rest 914 can be rotated back to be generally perpendicular to the seat 906. In some embodiments, the foot rest 914 can remain generally parallel to the seat 906, such as shown in FIG. 9B. A user can exercise on the flattened chair 900, such as stretching or otherwise. In some embodiments, such as shown in FIG. 9C, the arm rest 912 can be removed from the chair 900 when the chair 900 is in the flattened configuration.

In some embodiments, the chair 900 can be incorporated into the work cubicle 20 disclosed above, such as by functioning as the chair 282. For example, the chair 900 can have substantially the same as, or slightly smaller, dimensions as the cockpit area 280. When in the work mode, the back 904 can be in an upright position such as shown in FIG. 9A. When in the exercise mode, the back 904 can be rotated away from the seat 906 to form the substantially flat surface 918 such as shown in FIG. 9C. The substantially flat surface 918 can have substantially the same height as the bench top surface 256 and/or the platform surfaces 266 of the cubicle 20 in the extended position. In some embodiments, the chair 900 can include other configurations disclosed when functioning as the chair 282 in the cubicle 20.

In some embodiments, such as shown in FIG. 9D, the chair 900 in the flattened configuration can have the arm rest 912 attached to the seat 906. The arm rest 912 can have extensions 920, 922 that can be rotated about 90° so the extensions 920, 922 can be generally perpendicular to the substantially flat surface 918. As shown in FIG. 9F, the extensions 920, 922 can provide leg support when a user lies down with the user's back on the substantially flat surface 918 and one side of the user's hip in flexion. The extension 922 can be extended from the extension 920 to increase a length of the extensions to provide more contact area for the user's leg 926 at about 90° to the substantially flat surface 918 and/or the user's torso. In some embodiments, such as shown in FIG. 9E, the extensions 920 and/or 922 can include a concave support surface 924. The concave support surface 924 can generally conform to a shape of the user's leg 926 to improve user comfort. In some embodiments, such as shown in FIG. 9D, the user's other leg can be partially resting on the substantially flat surface 918. In some embodiments, the extensions 920, 922 can be extended on both arm rests 912 to support both legs of the user moved anteriorly.

Figure 9G:
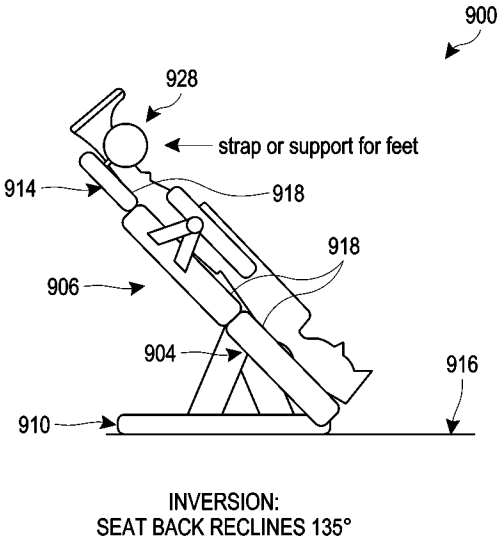
FIG. 9G schematically illustrates the chair of FIG. 9A in a partially inverted configuration.

In some embodiments, such as shown in FIG. 9G, the chair 900 can have a partially or inverted configuration. The seat 906, the back 904, and the foot rest 914 can be generally aligned such that surfaces of the seat 906, the back 904, and the foot rest 914 facing away from the support surface 916 can form the substantially flat surface 918. The seat 906, the back 904, and the foot rest 914 can be at an angle relative to the support surface 916. The back 904 can be closer to the support surface 916 than the foot rest 914. In some embodiments, such as shown in FIG. 9G, the seat 906, the back 904, and the foot rest 914 can be at an angle (for example, about 135°) relative to the support surface 916 such that a free end of the back 904 can be as low as the support surface contacting portion 910. In some embodiments, the free end of the back 904 can contact the support surface 916. In certain embodiments, the seat 906, the back 904, and the foot rest 914 can be at other angles relative to the support surface 916.

In some embodiments, such as shown in FIG. 9G, the foot rest 914 can include an ankle support 928 (for example, a strap, a piece of foam, or others). The user can lie on the chair with the user's head near the free end of the back 904 and the user's foot near the foot rest 914. The user's feet can extend between the foot rest 914 and the ankle support 928. The user's feet can contact the ankle support 928 to inhibit or prevent the user from slipping down from the chair 900 due to the pull of the gravity. In some embodiments, the user's feet can extend outward from a free end of the foot rest 914. The user can stretch various muscles and/or soft tissues (such as in the legs, the spine, or otherwise) using the chair 900 in the inverted configuration.

Certain Multi-Function Ottomans

Figure 11B:
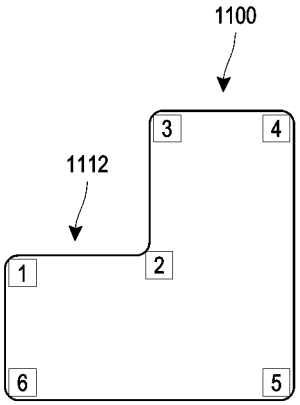
FIG. 11B schematically illustrates a top view of the first portion of the ottoman of FIG. 11A.
Figure 11A:
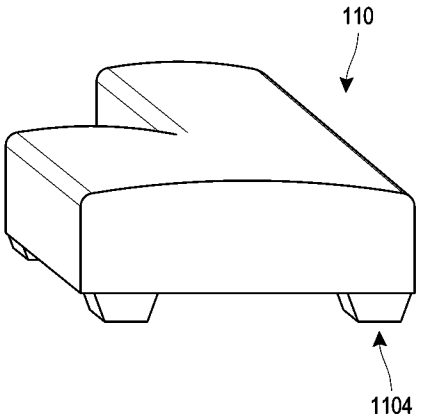
FIG. 11A schematically illustrates a front view of a first portion of an exercise ottoman.

FIGS. 11A-11H schematically illustrates an example multi-function two-part ottoman 110. The ottoman 110 can be used, for example, as the ottoman 480 of the cubicle 40 or with any other cubicle examples disclosed. The ottoman 110 can include a first portion 1100 having generally an L-shape in a top view. In some embodiments, such as shown in FIGS. 11A and 11B, the first portion 1100 can be generally square with a recess 1112. In some embodiments, the recess is generally shaped as a square. The first portion 1100 can have a length and/or width of about 45 inches to about 55 inches, or about 48 inches. The first portion 1100 can have a height of about 15 inches to about 25 inches, or about 20 inches. The recess 1112 can have a length and/or width of about half of the length and/or width of the first portion 1100. The size and shape of the recess 1112 can vary. In some embodiment, the first portion 1100 can include a plurality (such as six) of legs located as shown in FIG. 11B by the numbers 1-6. The leg 1104 can have a width of 1.5 inches to about 2.5 inches, or about 2 inches. The leg 1104 can have a height of 1.5 inches to about 2.5 inches, or about 2 inches. The first portion 1100 can have more or fewer legs.

Figure 11C:
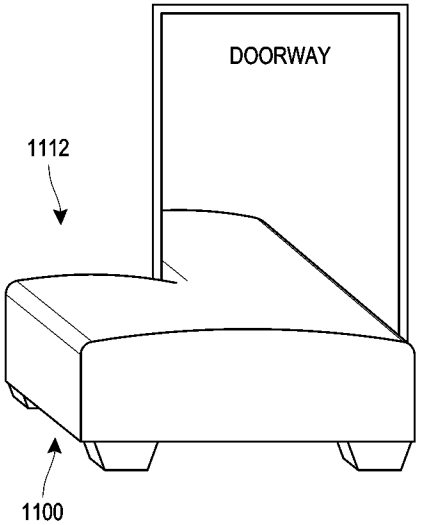
FIG. 11C schematically illustrates the first portion of the ottoman fitting through a doorway.
Figure 11D:
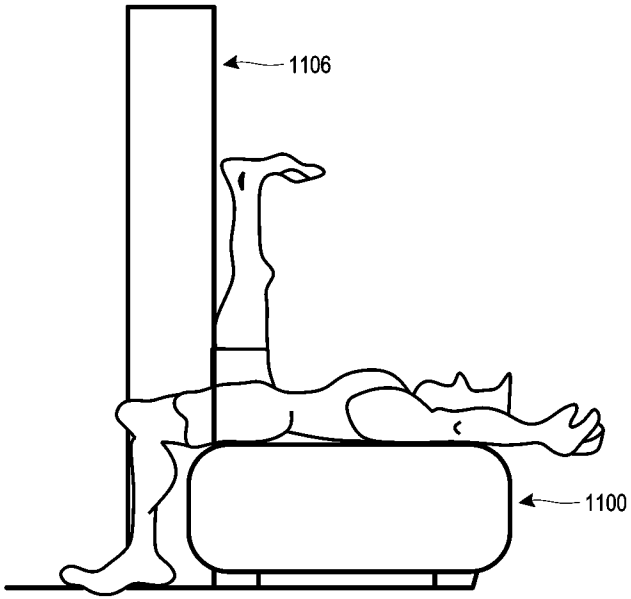
FIG. 11D schematically illustrates a user on the first portion of the ottoman of FIG. 11C against a vertical surface.

As shown in FIG. 11C, the first portion 1100 can be fitted through a doorway that is narrower than the length and/or width of the first portion 1100 because of the recess 1112. The side of the first portion 1100 with the recess 1112 can be pushed through the doorway first. The first portion 1100 can then be rotated (such as lifted and rotated) for the side with the full length and/or width to pass through the doorway. As shown in FIG. 11D, the first portion 1100 can be fitted through a doorway and/or placed against a vertical wall or column with the side having the recess 1112 flush against the doorway frame or the vertical wall or column. The user can lay flat on the back on the first portion 1100. The user's leg on the side of the first portion 1100 without the recess 1112 can be bent with the user's foot on the floor. The user's leg on the side of the recess 1112 can be lifted straight up against the doorway frame or vertical wall or column to stretch the straightened leg.

Figure 11E:
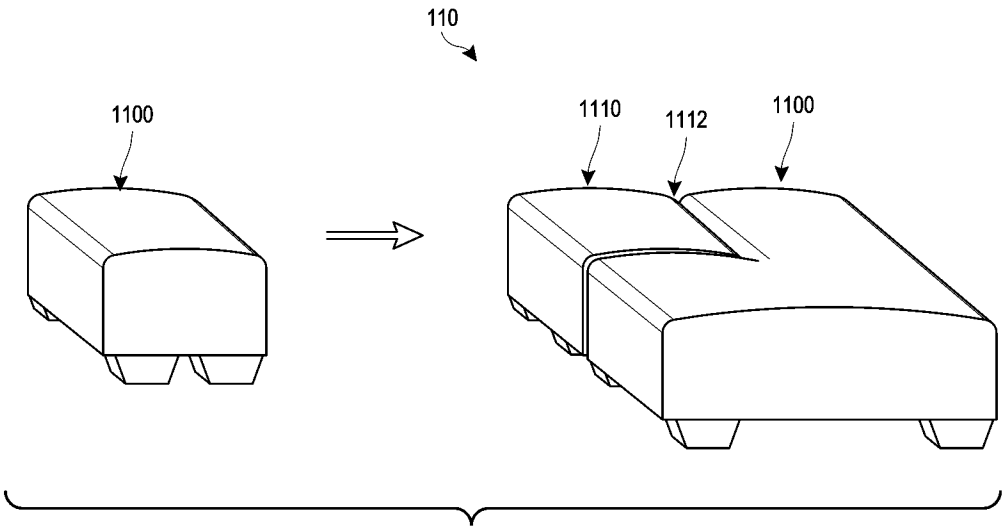
FIG. 11E schematically illustrates an assembly of the first portion and a second portion of the ottoman.
Figure 11F:
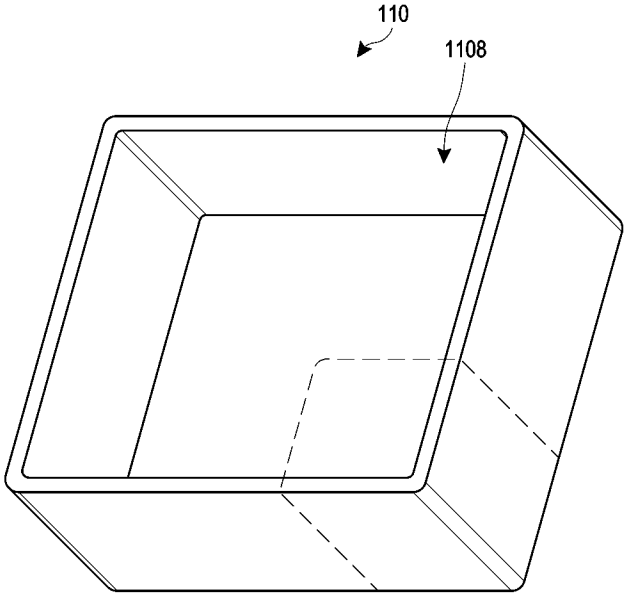
FIG. 11F schematically illustrates a bottom view of the ottoman of FIG. 11E.
Figure 11H:
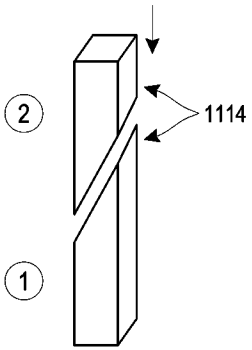
FIGS. 11G and 11H schematically illustrate an example connecting mechanism for coupling the first and second portions of the ottoman of FIG. 11E.
Figure 11G:
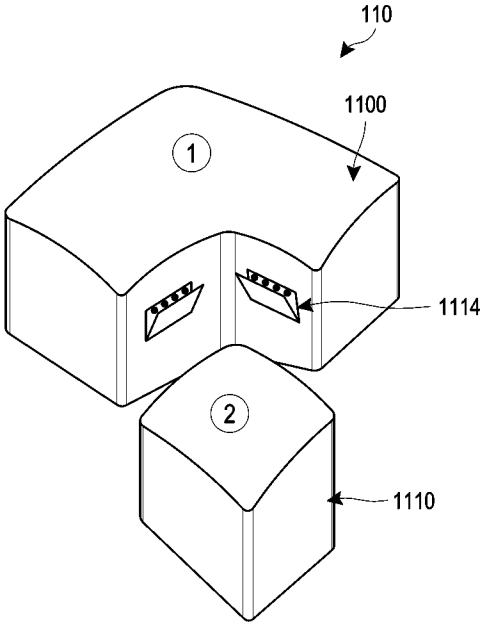

As shown in FIGS. 11E-11G, the ottoman 110 can include a second portion 1110 configured to be coupled with the first portion 1100. The second portion 1110 can have a dimension (e.g., height, width, and/or length) to be received in the recess 1112 of the first portion 1100. In some embodiments, such as shown in FIG. 11E, when the second portion 1110 is received in the recess 1112 of the first portion 1100, the top and/or side surfaces of the second portion 1110 can be generally flush with the top and/or side surfaces of the first portion 1100. In some implementations, the top surface of the first 1100 and/or second 1110 portions of the ottoman 110 can include a padded layer. In some embodiments, the padded layer can have a thickness of about 0.5 inch to about 1.5 inches, or about 1 inch. The padded layer can make the ottoman 110 more suitable for exercising, such as to improve user comfort, protect against injuries, or otherwise.

As shown in FIG. 11F, the bottom side of frames of the ottoman 110 can include a hollow box 1108. The frames can be made of plywood. In some embodiments, the plywood can be covered or wrapped in padding (e.g., thin and/or heavy-duty padding, padding having a thickness of about 0.5 inch to about 1.5 inches, or about 1 inch).

As shown in FIGS. 11G and 11H, the second portion 1110 can be removably coupled to the first portion 1100. In some embodiments, such as shown in FIGS. 1G and 1H, mating surfaces of the first 1100 and second 1110 portions can include one or more corresponding cleats 1114. The second portion 1110 can be lifted up and the cleats on the second portion 1100 can be slid down into the cleats 1114 of the first portion 1100. In other embodiments, different coupling mechanisms (e.g., hinges, Velcro connectors, or others) can be used to removably couple the first 1100 and second 1110 portions. In some variants, the first 1100 and second 1110 portions can be placed together with the mating surfaces in contact or substantially in contact without coupling mechanisms.

An embodiment of an article of convertible exercise furniture 1210 includes an ottoman providing a square planar top surface 1212 having a generally uninterrupted flat surface adapted to provide a workout platform, FIGS. 12A-16. The ottoman further includes a square planar second surface 1224 of equal size to the top surface 1212 and below the top surface 1212. The ottoman further includes a square planar third surface 1216 of equal size to the planar second surface 1214 below the planar second surface 1214. An equal sized support leg 1218 in each corner of the square planar top surface 1212, second surface 1214, and third surface 1216, provides interconnecting points among the surfaces and support to the three ottoman surfaces above the floor surface under each support leg 1218. In some embodiments a user could provide a yoga mat or similar padded material on the central portion of the planar top surface 1212 of the workout platform. In some embodiments the height of the planar top surface 1212 above the floor surface is 26 inches.

An embodiment of convertible furniture 1210 includes a plurality of equal sized paired openings 1220 through the ottoman square planar top surface 1212 and second surface 1214 and workout platform, FIGS. 12B-14B. In some variants, the plurality of equal sized paired openings 1220 are arranged in mirrored image arrays on the periphery side boundaries of the square planar top surface 1212 and the second surface 1214. In one variant, each mirrored image array is a 2×7 array between two 1×1 and 3×2 arrays providing paired longitudinal arrays of 1×11, 1×13, and two 3×1 and paired transverse arrays of nine 2×1 and four 3×6, FIGS. 12B, 13B-14B.

Figure 12A:
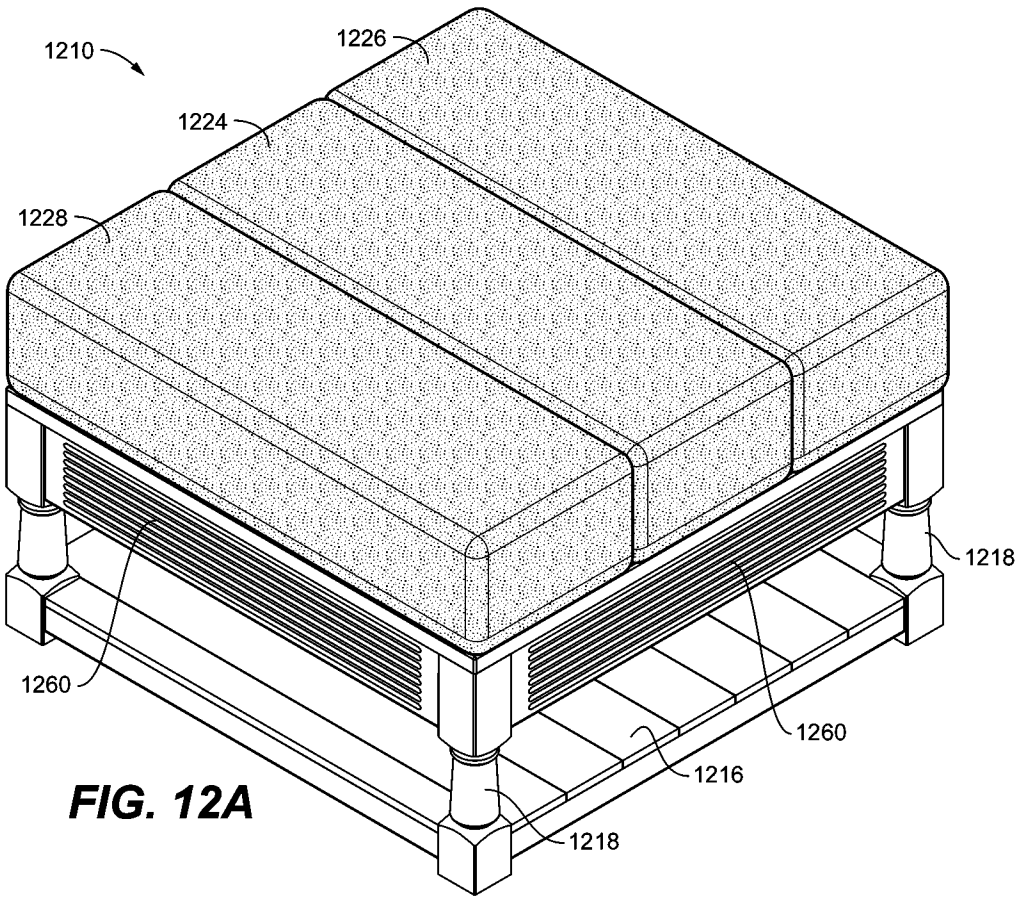
FIG. 12A schematically illustrates a left front top perspective view of an embodiment of convertible furniture 1210.
Figure 12B:
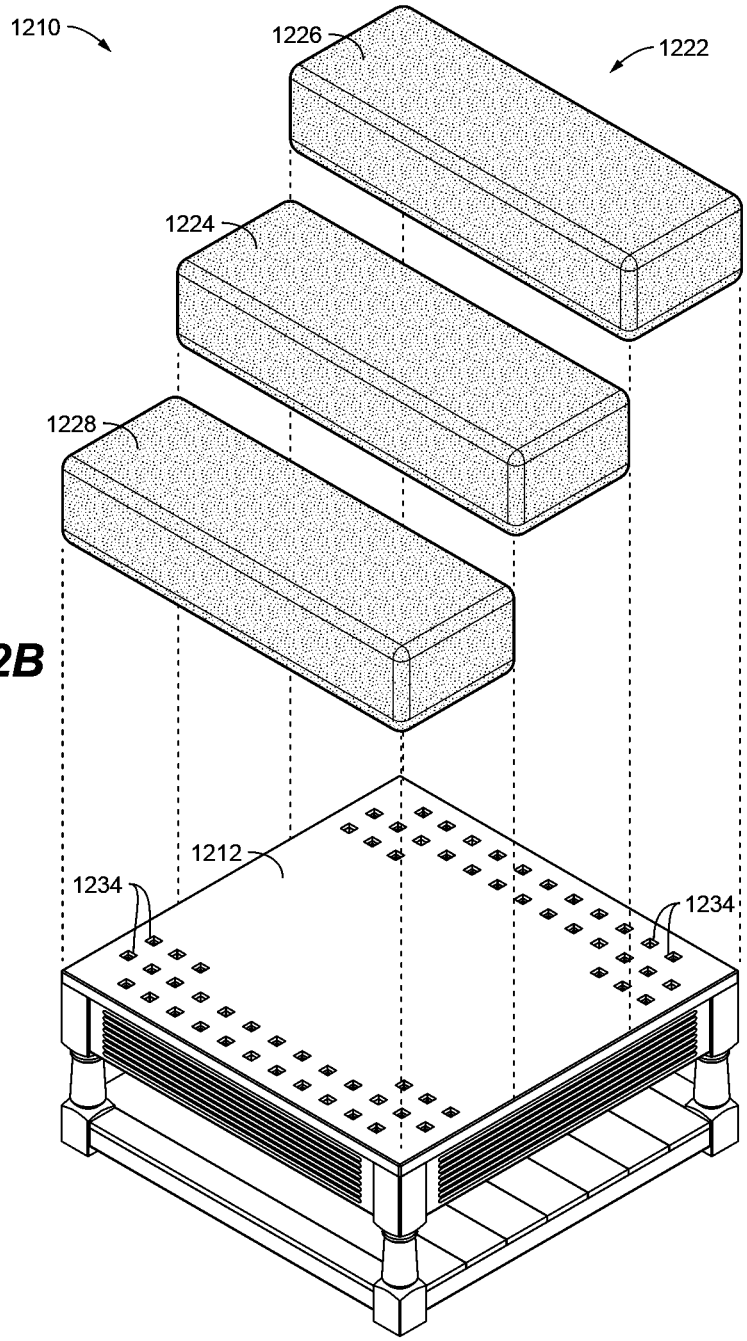
FIG. 12B schematically illustrates a left front top perspective view of FIG. 12A with a tri-part cover 1222 removed for transfer into workout platform.
Figure 13A:
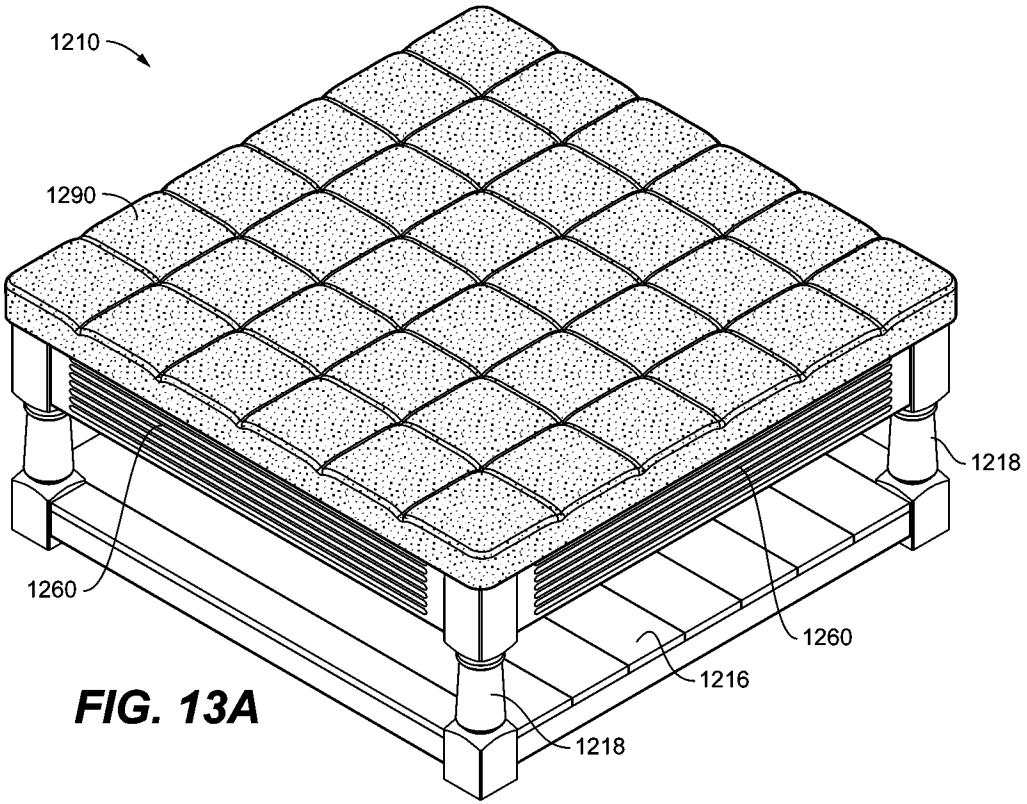
FIG. 13A schematically illustrates a left front top perspective view of an embodiment of convertible furniture 1210.
Figure 13B:
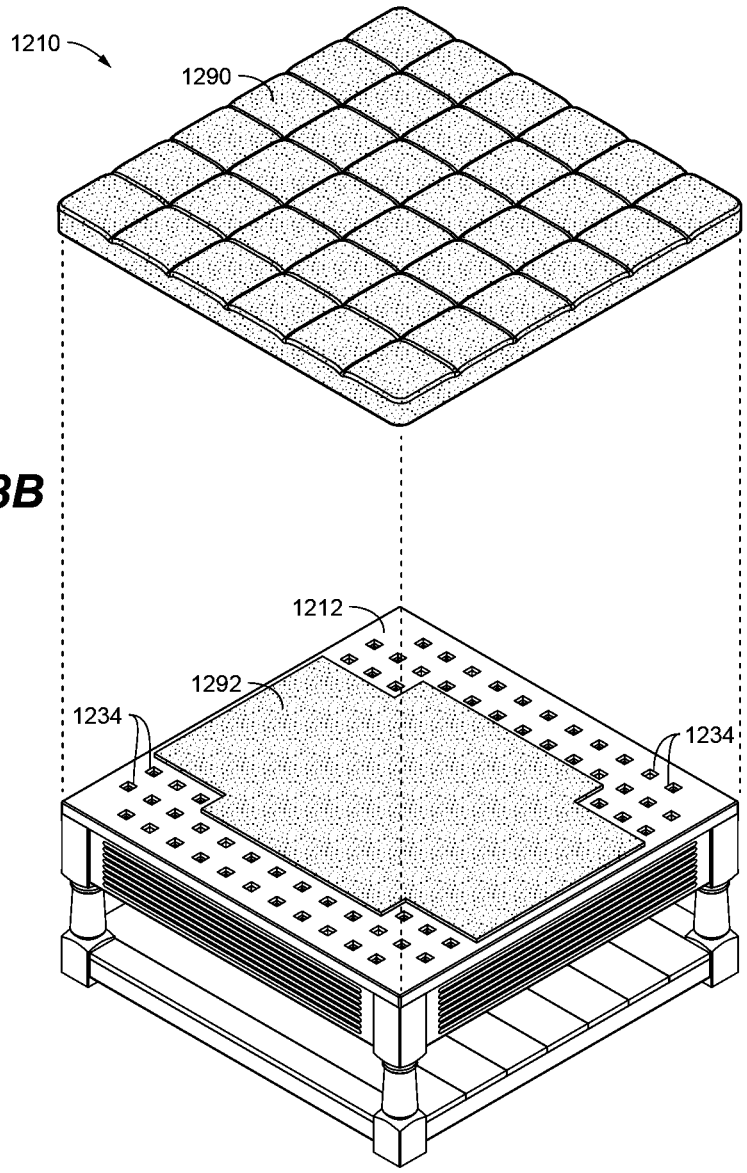
FIG. 13B schematically illustrates a left front top perspective view of FIG. 13A with a button-tufted cover 1290 removed for transfer into workout platform providing an exercise workout surface 1292.

An embodiment of convertible furniture 1210 includes a tri-part padded cover 1222 sized to fit the square planar top surface 1212, the padded cover 1222 providing a removable central portion 1224, a removable first edge portion 1226, and a removable second edge portion 1228 covering the plurality of equal sized openings 1220 through the square planar top surface 1212, FIGS. 12A-12B. Bottom surfaces of the central portion 1224, a removable first edge portion 1226, and a removable second edge portion 1228 provide an assembly to allow the central and side portions to be removably separable from the planar top surface 1212 to provide the workout platform. When the central portion 1224, a removable first edge portion 1226, and a removable second edge portion 1228 are separated from the planar top surface 1212 and workout platform, the convertible furniture is in an exercise mode, providing exercise attachment assembly access and support to the workout platform. In some embodiments, Velcro connectors (not shown) can be used to removably couple the padded cover 1222 from the square planar top surface 1212. In some variants, the padded cover 1222 can be a unitary piece on the entire square planar top surface 1212 (not shown). Other variants provide use of a button-tufted cover 1290 over an exercise workout surface 1292, FIGS. 13A and 13B. It is understood exercise workout surface 1290 may be part of embodiments of convertible furniture 1210 providing a tri-part padded cover 1222 sized to fit the square planar top surface 1212, the padded cover 1222 providing a removable central portion 1224, a removable first edge portion 1226, and a removable second edge portion 1228 covering the plurality of equal sized openings 1220 through the square planar top surface 1212, FIGS. 12A-12B. It is further understood that for embodiments of convertible furniture 1210 not providing an exercise workout surface 1290, a user may prefer substituting a yoga mat or other removable surface (not shown) to the top surface 1212 workout platform. Some variants include a padded workout surface 1292 under either the tri-part padded cover 1222 or the button-tufted cover 1290 and affixed to the portion of the planar top surface without openings, FIG. 13B.

Figure 14A:
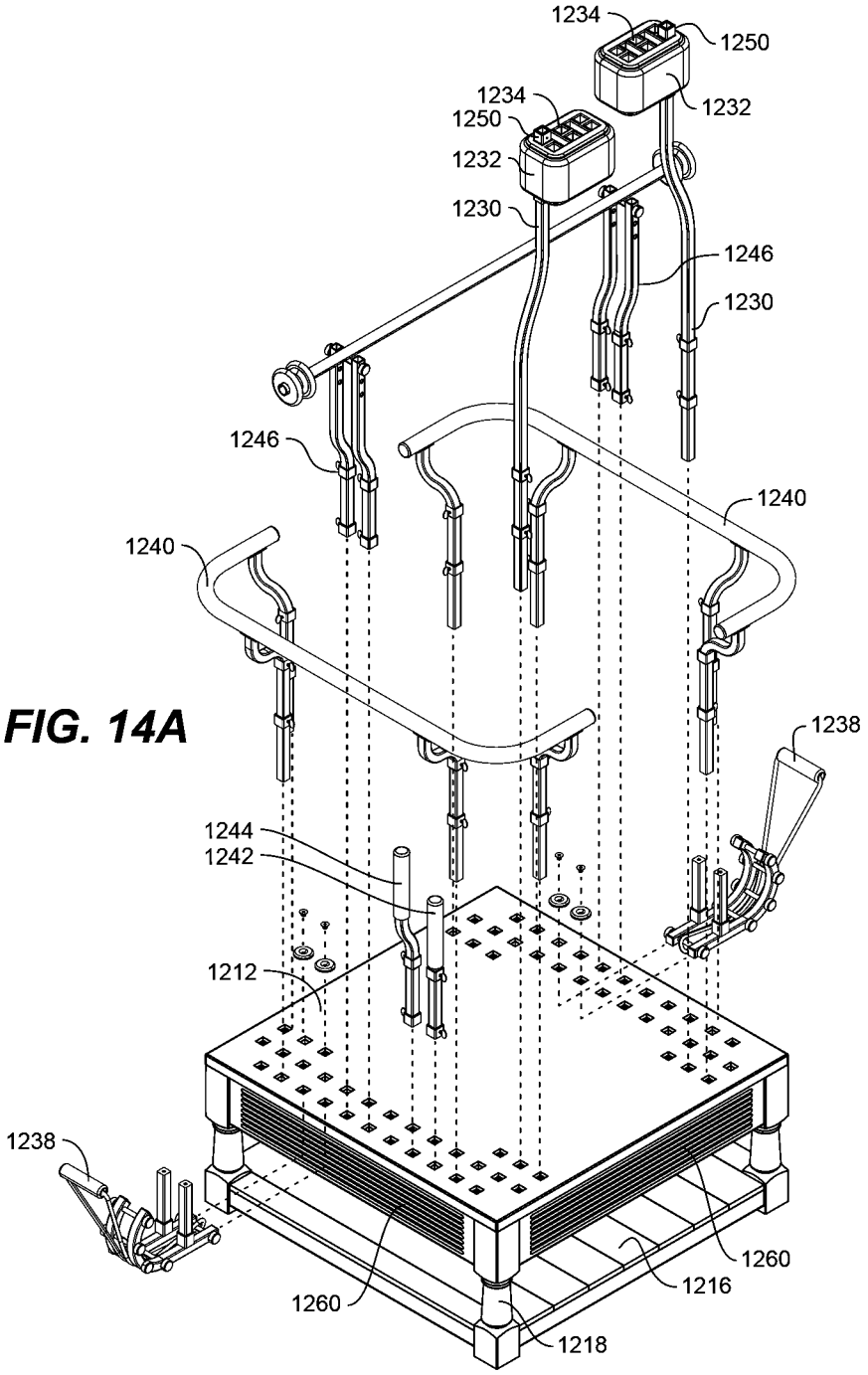
FIG. 14A schematically illustrates a left front top exploded perspective view of FIG. 12A absent the tripart cover 1222 center portion 1224. First edge portion, 1226, and second edge portion 1228, with a plurality of exercise attachments positionally configured openings 1220 in the square planar top surface 1212 of the workout platform.
Figure 14B:
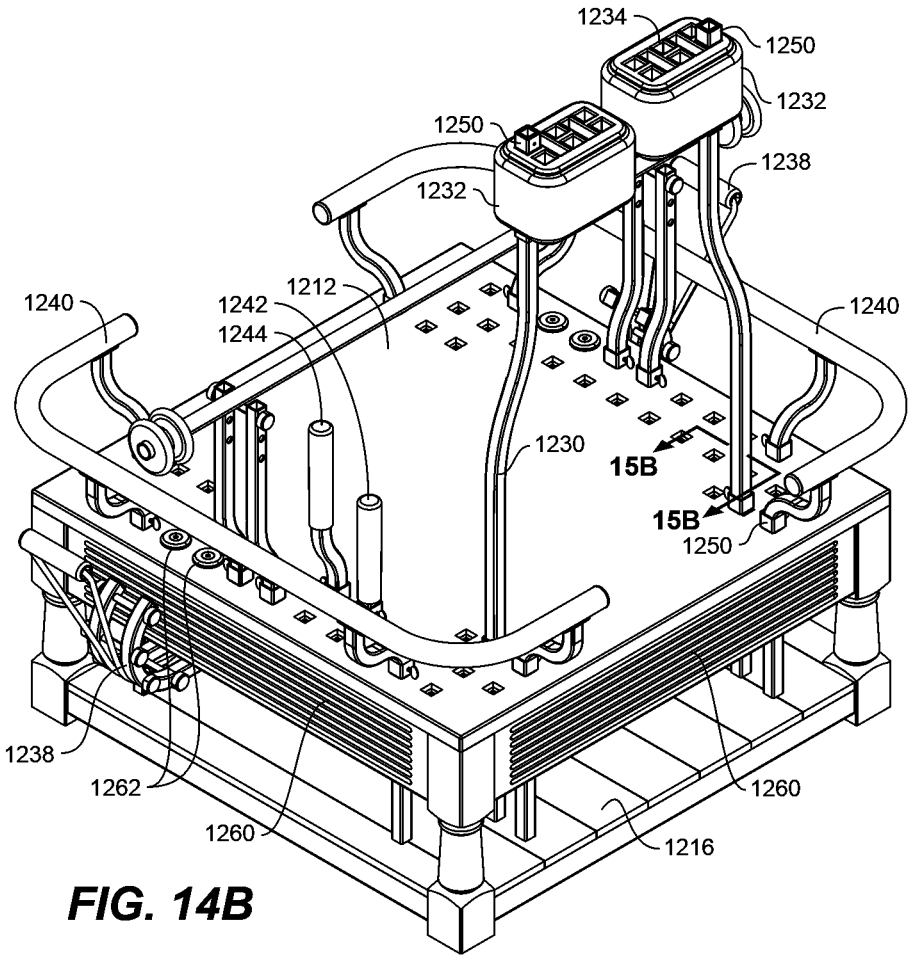
FIG. 14B schematically illustrates a left front top perspective view of FIG. 14A with the plurality of exercise attachments affixed to the square planar top surface 1212 of the workout platform.
Figure 15A:
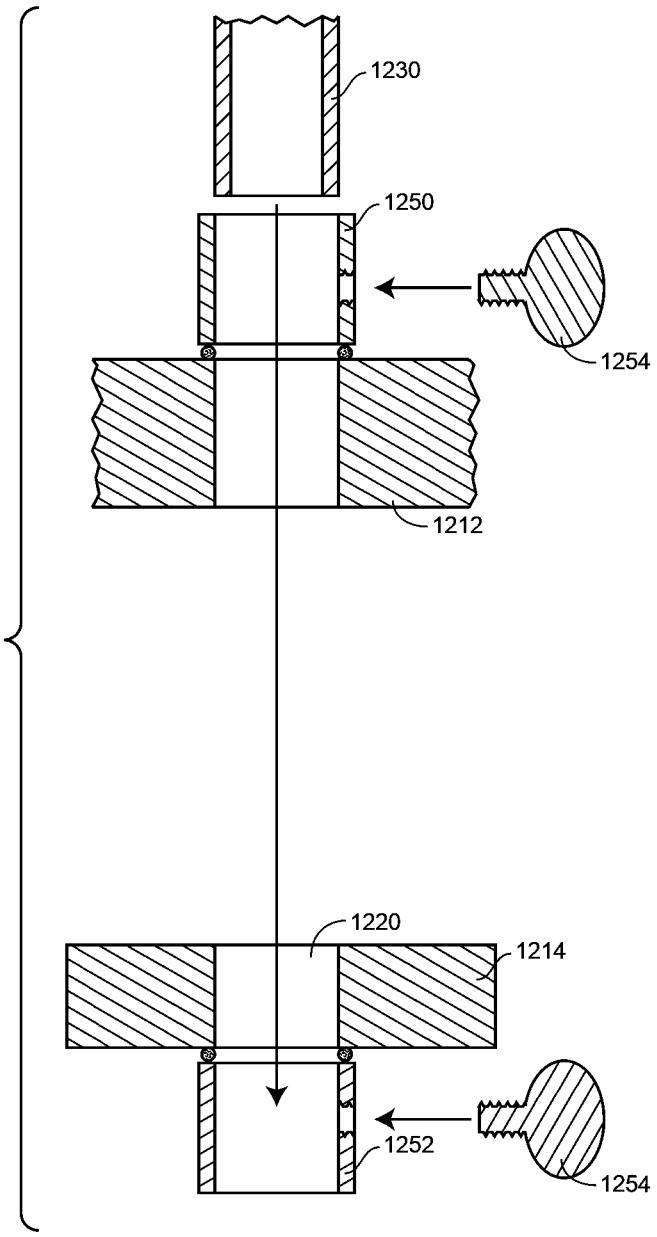
FIG. 15A a is representative a cross sectional view of equal sized paired openings 1220 through the workout platform square planar top surface 1212 and second surface 1214 for an embodiment of convertible furniture.
Figure 15B:
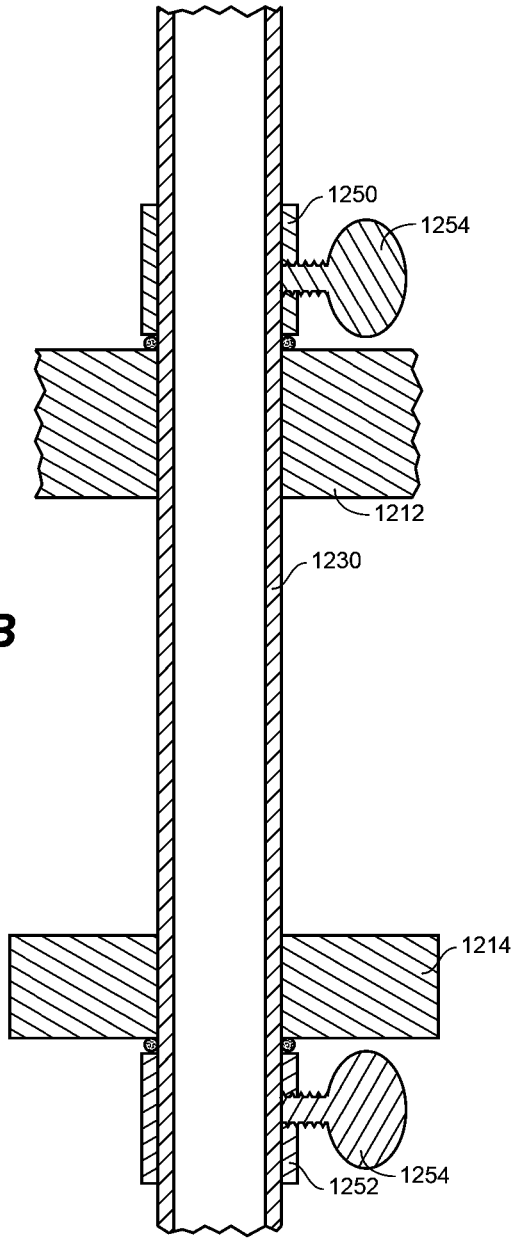
FIG. 15B illustrates a representative attachment assembly support leg secured by the top collar 1250 and collar lock key 1254 and the bottom collar 1252 and collar lock key 1254 of FIG. 15A.

An embodiment of convertible furniture 1210 provides a plurality of exercise attachment assemblies, FIGS. 14A and 14B. Except for the chest expansion extension attachment assembly 1238, each assembly includes support legs sized to be received in and secured by least one pair of paired openings 1220 through the square planar top surface 1212 and the second surface 1214, and providing a top collar 1250 and collar lock key 1254, and a bottom collar 1252 and a collar lock key 1254 for securing each support leg to the square planar top surface 1212 and the second surface 1214 completing attachment of the assembly to the workout platform, FIGS. 15A-16. In some variants, each attachment assembly support leg provides an integral marking (not shown) for aligning the support leg height on the square planar to surface before securing the top collar 1250 and collar lock key 1254.

The plurality of exercise equipment assemblies for an embodiment of convertible furniture 1210 includes at least one vertical leg extension attachment assembly 1229 and leg extension adjustable padded surface 1232 with adjustable padded surface slots 1234 for a user lying on his back on the exercise workout surface 1292 and resting one foot on the floor and extending the opposite leg straight up above the hip with adjustable extension support for the leg by supporting the back of the foot on the extended leg, FIGS. 13A-15. The leg extension adjustable padded surface 1232 provides alternative adjustable positions by positioning the leg extension attachment assembly 1229 support leg into one of array of padded surface slots 1234, further providing a top collar 1250 and a collar lock key 1254, and a bottom collar 1252 and a collar lock key 1254 to vary the angle of the user's straight leg extended above the hip according to the user's range flexibility.

The plurality of exercise equipment assemblies for an embodiment of convertible furniture includes at least two side chest expansion attachment assemblies 1238 providing lateral support and resistance for each user's arms traveling transversely with respect to the user's spine, FIGS. 14A-14B, 16-18. Each chest expansion assembly 1238 is attached to the workout platform and supported by a pair of chest expansion assembly legs 1236 each of which are inserted from the planar top surface 1212 with attachment thereto by an upper collar lock 1262 for the chest expansion assemblies and attached to the respective chest expansion attachment assembly between the planar second surface 1214 and the planar third surface 1216, FIGS. 13A-15, using a bottom collar 1252 and a collar lock key 1254. Each chest expansion attachment assembly provides parallel curved frame rails 1268 joined by a plurality of frame rail connector pins 1272. Rotating frame rail surface covers 1270 over the connector pins 1272 allow the replaceable chest expansion band 1264 to stretch from its connection point to the frame rail 1274 all the way through to the hand grip 1266 when activated by the user.

Figure 16:
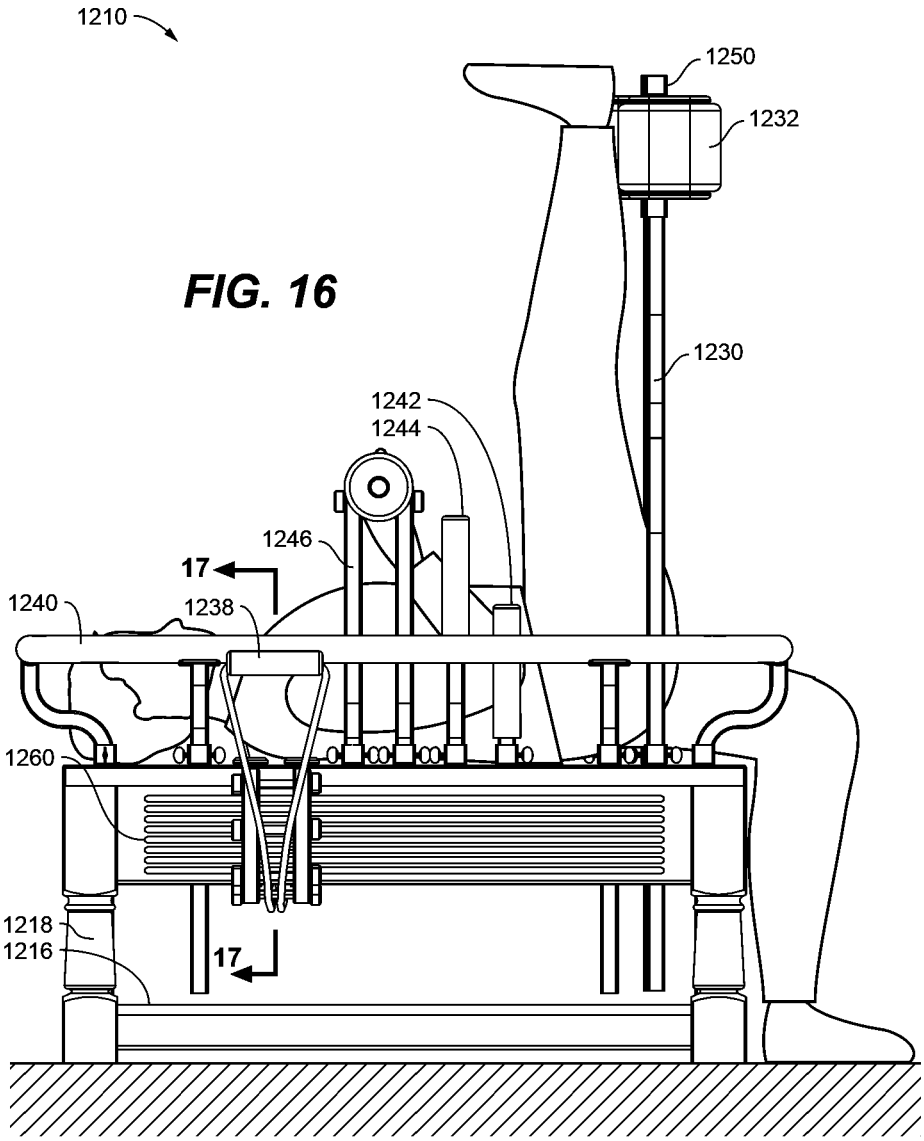
FIG. 16 is left side elevational view of FIG. 14B with a user on the workout platform.
Figure 17:
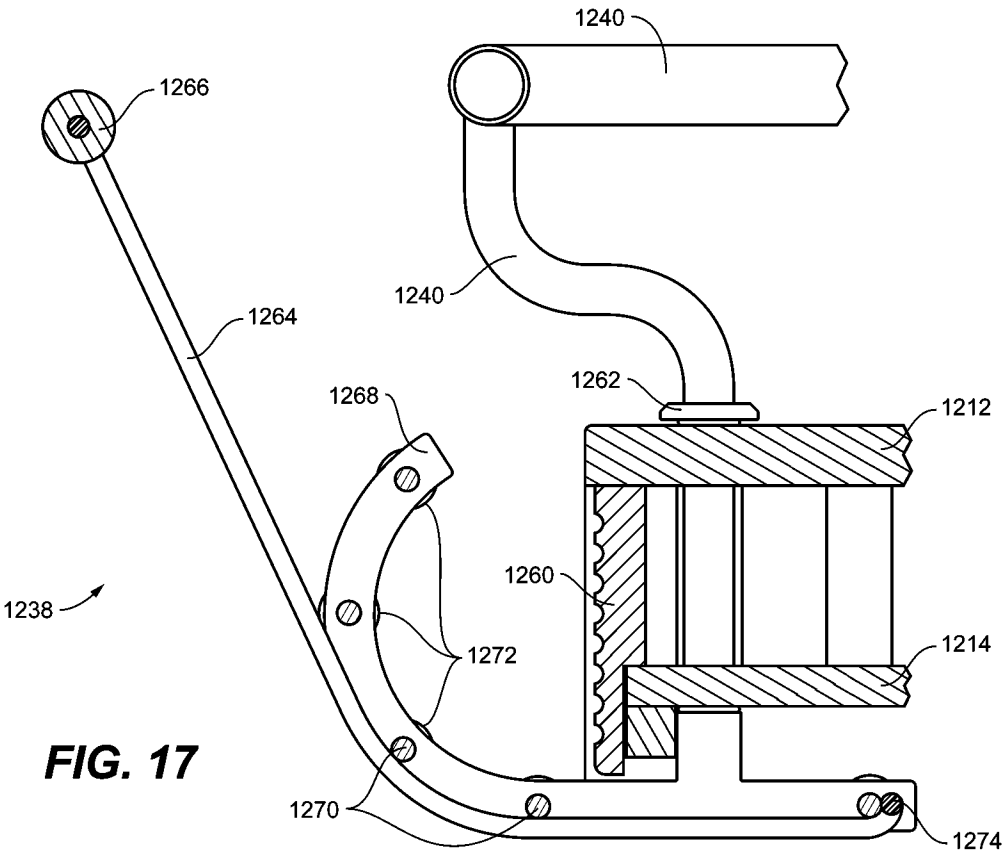
FIG. 17 is a cross-sectional view of FIG. 16 taken at "17-17."
Figure 18:
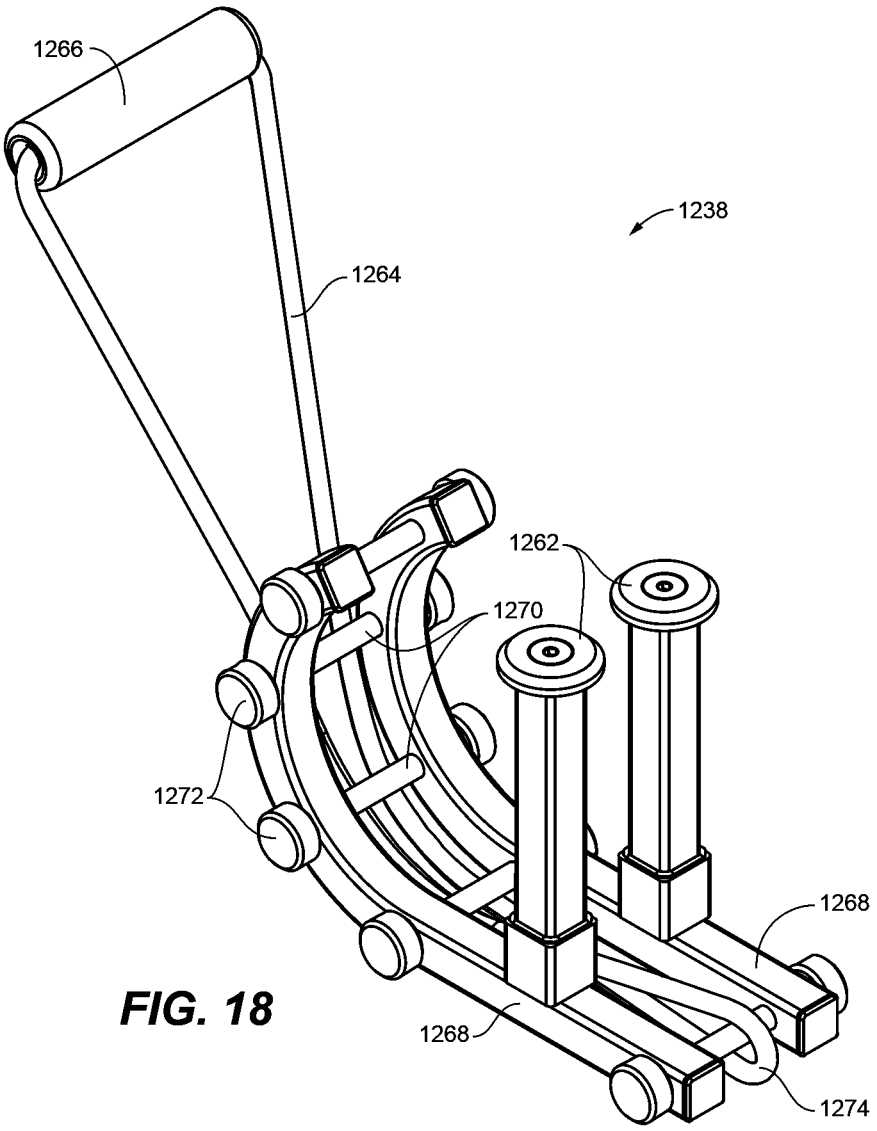
FIG. 18 is a top left perspective view of the chest attachment expansion assembly 1238.

The plurality of exercise equipment assemblies for an embodiment of convertible furniture includes at least one side rail support attachment assembly 1240 at equal height above the planar top surface 12, FIGS. 14A-14B, 16. This rail support attachment assembly 1240 serves as the extension for numerous stretching postures, on or off the work platform. The rail support attachment assembly 1240 further provides attachment surfaces and support for on or off work platform stretching bands for full body strength and stretching routines. The rail support attachment assembly 1240 also is a support base or balance stabilizer for dynamic body weight exercises such as lunges, squats, pushups, tri-cep dips, and planks or strength building through isometric postures.

The plurality of exercise equipment assemblies for an embodiment of convertible furniture includes at least one single hand grip attachment assembly 1242, FIGS. 14A-14B, 16. The single hand grip attachment assembly 1242 is useful for cross-body stretching on or off the work platform, when used alone or with the curved single hand grip attachment assembly 1244.

The plurality of exercise equipment assemblies for an embodiment of convertible furniture includes at least one curved single hand grip attachment assembly 1244, FIGS. 14A-14B, 16. The curved single hand grip attachment assembly 1244 is useful for cross-body stretching on or off the work platform, when used alone or with the single hand grip attachment assembly 1242.

The plurality of exercise equipment assemblies for an embodiment of convertible furniture includes at least adjustable two bench press attachment assemblies 1246 at equal height above the planar top surface 12, FIGS. 14A-14B, 16.

The disclosed exercise assemblies provide support for additional exercise assemblies including, at least one cable pull support, at least one pushup bar, at least one elastic resistance cord (not shown) all as supplementation to the at least one side rail support attachment assembly 1240 at equal height above the planar top surface 1212.

The disclosed exercise assemblies provide support for at least one adjustable and rotatable mounting bracket for at least one computer monitor screen and can accommodate electrical wires (not shown) all as supplementation to the at least one side rail support attachment assembly 1240 at equal height above the planar top surface 1212.

Certain Terminology

Terms of orientation used, such as "top," "bottom," "horizontal," "vertical," "side," and "end" are used in the illustrated embodiment. However, the present disclosure should not be limited to the illustrated orientation. Other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms do not have to conform strictly to the mathematical definitions of circles or cylinders or other structures but can encompass structures that are reasonably close approximations.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language rarely is intended to imply that features, elements, and/or steps are required for one or more embodiments or that one or more embodiments include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from parallel by less than or equal to 15 degrees.

CONCLUSION

While several variations of the disclosure have been shown and described, other modifications, which are within the scope of this disclosure, will be readily apparent to those of skill in the art based upon this disclosure. It is also contemplated that various combinations or sub-combinations of the specific features and aspects of the embodiments may be made and still fall within the scope of the disclosure. It should be understood that various features and aspects of the disclosed embodiments can be combined with or substituted for one another to form varying modes of the disclosed.

Furthermore, certain features described in this disclosure in separate implementations can also be implemented in combination in a single implementation. Conversely, various features described in a single implementation can also be implemented in multiple implementations separately or in any suitable subcombination. Although features may be described above as acting in certain combinations, one or more features from a claimed combination can, sometimes, be excised from the combination, and the combination may be claimed as a subcombination or variation of a subcombination.

Features, materials, characteristics, or groups described with a particular aspect, embodiment, or example are to be understood to apply to any other aspect, embodiment or example described in this section or elsewhere in this specification unless incompatible therewith. The features disclosed in this specification (including any claims, abstract and drawings) may be combined in any combination, except combinations where at least some of such features and/or steps are mutually exclusive. The protection is not restricted to the details of any foregoing embodiments. The protection extends to any novel one, or any novel combination, of the features disclosed in this specification (including any claims, abstract and drawings), or to any novel one, or any novel combination so disclosed.

For this disclosure, certain aspects, advantages, and novel features are described herein. Not necessarily all such advantages may be achieved under any particular embodiment. Thus, for example, those skilled in the art will recognize that the disclosure may be embodied or carried out so it achieves one advantage or a group of advantages as taught herein without achieving other advantages as taught or suggested herein.

Some embodiments have been described to accompany drawings. The figures are drawn to scale where appropriate, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like with various embodiments can be used in all other embodiments set forth herein. And any methods described may be practiced using any device suitable for performing the recited steps.

Although this invention has been disclosed in certain embodiments and examples, the scope of this disclosure extends beyond the specifically disclosed embodiments to other alternative embodiments and/or uses of the invention and obvious modifications and equivalents thereof. Any system, method, and device described in this application can include any combination of the preceding features described in this and other paragraphs, among other features and combinations described, including features and combinations described in subsequent paragraphs. While several variations of the invention have been shown and described, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Various features and aspects of the disclosed embodiments can be combined with, or substituted for, one another to form varying modes of the disclosed invention. Thus, it is intended that the present invention herein disclosed should not be limited by the particular disclosed embodiments described above but should be determined only by fairly reading the claims that follow.

The following is claimed:

1. An article of convertible furniture comprising:

A) an ottoman comprising:

B) a square planar top surface comprising a generally uninterrupted flat surface adapted to provide a workout platform;

C) a square planar second surface of equal size to the top surface and below the top surface;

D) a square planar third surface of equal size to the planar second surface below the planar second surface;

E) an equal sized support leg in each corner of the square planar top, second and third surfaces, providing interconnecting points among the square planar top, second and third surfaces and support to the square planar top, second and third surfaces above a floor surface under each support leg;

F) a plurality of equal sized paired openings through the square planar top and second surfaces and workout platform;

G) a removable furniture cover assembly sized to fit the square planar top surface and be removably separable from the planar top surface and workout platform; and H) a plurality of exercise attachment assemblies comprising support legs sized to be received in and secured by least one pair of paired openings through the square planar top and second surfaces, and further comprising assemblies for securing each support leg to the top surface workout platform and second surface;

wherein: when the removable furniture cover is separated from the planar top surface and workout platform, the convertible furniture is in an exercise mode, providing exercise attachment assembly access, stability, and support to the workout platform.

2. The convertible furniture of claim 1, wherein the plurality of exercise equipment attachment assemblies comprises at least one vertical leg extension support for a user lying on his back on a padded top surface workout platform and resting one foot on the floor and extending the opposite leg straight up above the hip with adjustable extension support for the leg by supporting the back of the foot on the extended leg.

3. The convertible furniture of claim 1, wherein the plurality of exercise equipment attachment assemblies comprises at least two side chest expansion supports providing lateral support and resistance for each user's arms traveling transversely with respect to the user's spine.

4. The convertible furniture of claim 1, wherein the plurality of exercise equipment attachment assemblies comprises at least two side rail supports at equal height above the planar top surface.

5. The convertible furniture of claim 4, wherein the plurality of exercise equipment attachment assemblies comprises at least one cable pull support, at least one pushup bar, at least one elastic resistance cord as supplementation to at least one of the side rail supports.

6. The convertible furniture of claim 4, wherein the plurality of exercise equipment attachment assemblies comprises at least one adjustable and rotatable mounting bracket for at least one computer monitor screen and can accommodate electrical wires as supplementation to at least one of the side rail supports.

7. The convertible furniture of claim 1, wherein the plurality of exercise equipment attachment assemblies comprises at least two adjustable bench press supports at equal height above the planar top surface.

8. The convertible furniture of claim 1, wherein the plurality of exercise equipment attachment assemblies comprises at least one single hand grip.

9. The convertible furniture of claim 1, wherein the plurality of exercise equipment attachment assemblies comprises at least one curved hand grip.

10. The convertible furniture of claim 1, wherein assemblies for securing each support leg to the top surface workout platform and second surface comprise a top collar and collar lock key, and a bottom collar and a collar lock key for all exercise equipment attachment assemblies except a chest extension attachment assembly.

11. The convertible furniture of claim 1, wherein assemblies for securing each support leg to the top surface workout platform and second surface for a chest extension attachment assembly comprise a top collar lock, and a bottom collar and a collar lock key.

12. An article of convertible furniture comprising:

A) an ottoman comprising:

B) a square planar top surface comprising a generally uninterrupted flat surface adapted to provide a workout platform;

C) a square planar second surface of equal size to the top surface and below the top surface;

D) a square planar third surface of equal size to the planar second surface below the planar second surface;

E) an equal sized support leg in each corner of the square planar top, second and third surfaces, providing interconnecting points among the square planar top, second and third surfaces and support to the square planar top, second and third surfaces above a floor surface under each support leg;

F) a plurality of equal sized paired openings through the square planar top and second surfaces and workout platform;

G) a removable furniture cover assembly sized to fit the square planar top surface and be removably separable from the planar top surface and workout platform;

H) a padded workout surface under the furniture cover assembly and affixed to the portion of the planar top surface without openings; and I) a plurality of exercise attachment assemblies comprising support legs sized to be received in and secured by least one pair of paired openings through the square planar top and second surfaces, and further comprising assemblies for securing each support leg to the top surface workout platform and second surface;

wherein: when the cover assembly is separated from the planar top surface and workout platform, the convertible furniture is in an exercise mode, providing exercise attachment assembly access, stability, and support to the workout platform and padded workout surface.

13. The convertible furniture of claim 12, wherein the plurality of exercise equipment attachment assemblies comprises at least one vertical leg extension support for a user lying on his back on a padded top surface workout platform and resting one foot on the floor and extending the opposite leg straight up above the hip with adjustable extension support for the leg by supporting the back of the foot on the extended leg.

14. The convertible furniture of claim 12, wherein the plurality of exercise equipment attachment assemblies comprises at least two side chest expansion supports providing lateral support and resistance for each user's arms traveling transversely with respect to the user's spine.

15. The convertible furniture of claim 12, wherein the plurality of exercise equipment attachment assemblies comprises at least two side rail supports at equal height above planar top surface.

16. The convertible furniture of claim 15, wherein the plurality of exercise equipment attachment assemblies comprises at least one cable pull support, at least one pushup bar, at least one elastic resistance cord as supplementation to at least one of the side rail supports.

17. The convertible furniture of claim 15, wherein the plurality of exercise equipment attachment assemblies comprises at least one adjustable and rotatable mounting bracket for at least one computer monitor screen and can accommodate electrical wires as supplementation to at least one of the side rail supports.

18. The convertible furniture of claim 12, wherein the plurality of exercise equipment attachment assemblies comprises at least two adjustable bench press supports at equal height above the planar top surface.

19. The convertible furniture of claim 12, wherein the plurality of exercise equipment attachment assemblies comprises at least one single hand grip.

20. The convertible furniture of claim 12, wherein the plurality of exercise equipment assemblies comprises at least one curved hand grip.

21. The convertible furniture of claim 12, wherein assemblies for securing each support leg to the top surface workout platform and second surface comprise a top collar and collar lock key, and a bottom collar and a collar lock key for all exercise equipment attachment assemblies except a chest extension attachment assembly.

22. The convertible furniture of claim 12, wherein assemblies for securing each support leg to the top surface workout platform and second surface for a chest extension attachment assembly comprise a top collar lock, and a bottom collar and a collar lock key.

* * * * *